US007604332B2

(12) United States Patent
Nagashima

(10) Patent No.: US 7,604,332 B2
(45) Date of Patent: Oct. 20, 2009

(54) LIQUID EJECTION HEAD AND IMAGE FORMING APPARATUS COMPRISING SAME

(75) Inventor: Kanji Nagashima, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 404 days.

(21) Appl. No.: 11/727,810

(22) Filed: Mar. 28, 2007

(65) Prior Publication Data

US 2007/0229611 A1 Oct. 4, 2007

(30) Foreign Application Priority Data

Mar. 29, 2006 (JP) ..... 2006-092303

(51) Int. Cl.
*B41J 2/17* (2006.01)

(52) U.S. Cl. ..... 347/84; 347/22; 347/34; 347/85

(58) Field of Classification Search ..... 347/84, 347/85, 22, 34
See application file for complete search history.

(56) References Cited

U.S. PATENT DOCUMENTS 4,223,324 A * 9/1980 Yamamori et al. ..... 347/21
4,369,450 A * 1/1983 Iwagami et al. ..... 347/34
6,621,554 B1 * 9/2003 Ayash et al. ..... 355/30

FOREIGN PATENT DOCUMENTS

JP 2000-79696 A 3/2000
JP 2004-330446 A 11/2004
JP 2004-330615 A 11/2004

* cited by examiner

*Primary Examiner*—Seungsook Ham
*Assistant Examiner*—Rut Patel
(74) *Attorney, Agent, or Firm*—Birch, Stewart, Kolasch & Birch, LLP

(57) ABSTRACT

The liquid ejection head includes: a casing; nozzles which eject droplets of liquid containing a volatile solvent and are arranged on a nozzle face in the casing; an air outlet which supplies an air flow containing a vapor of the volatile solvent and is arranged on an upstream side in the air flow with respect to the nozzle face; an air inlet which recovers the air flow containing the vapor of the volatile solvent supplied from the air outlet and is arranged on the downstream side in the air flow with respect to the nozzle face; and an air flow circulation mechanism including a circulation device which resupplies, from the air outlet, the air flow containing the vapor of the volatile solvent recovered through the air inlet, wherein the air flow containing the vapor of the volatile solvent is circulated inside the casing.

17 Claims, 11 Drawing Sheets

LIQUID EJECTION HEAD AND IMAGE FORMING APPARATUS COMPRISING SAME

BACKGROUND OF THE INVENTION

1. Field of the Invention

The present invention relates to a liquid ejection head, and an image forming apparatus comprising the liquid ejection head, more particularly to a liquid ejection head which prevents the evaporation of volatile solvent contained in ink.

2. Description of the Related Art

As an image forming apparatus, an inkjet recording apparatus or inkjet printer is known, which includes a liquid ejection head or inkjet printer head having an arrangement of a plurality of liquid ejection nozzles and which records an image on a recording medium by ejecting liquid or ink from the nozzles toward the recording medium while causing the inkjet head and the recording medium to move relatively to each other.

The inkjet head of the inkjet printer has pressure generating units, each including, for example, a pressure chamber to which ink is supplied from an ink tank through an ink supply channel, a piezoelectric element which is driven by an electrical signal in accordance with image data, a diaphragm which serves as a portion of the pressure chamber and deforms in accordance with the driving of the piezoelectric element, and a nozzle which is connected to the pressure chamber and from which the ink inside the pressure chamber is ejected in the form of a droplet due to the volume of the pressure chamber being reduced by the deformation of the diaphragm. In the inkjet printer, one image is formed on a recording medium by combining dots formed by the ink droplets ejected from the nozzles of the pressure generating units.

The ink comprises a dye or pigment, and a solvent, and the like, and when left for a long period of time in a dry atmosphere, the solvent evaporates, the viscosity of the ink increases, and the ink becomes highly viscous. In other words, if the ink is left in an unused state for a long period of time in the nozzles of the inkjet printer, then the solvent component contained in the ink evaporates from the surface of the ink in the nozzles, and the ink in the vicinity of the nozzles becomes highly viscous. If the ink becomes highly viscous in this way, then during normal driving by piezoelectric elements, the ink cannot be ejected from the nozzles and nozzle blockages occur. If a nozzle blockage of this kind occurs, it is not possible to record the pixels that are to be recorded by that nozzle, onto the recording medium, and therefore a white stripe, or the like, where nothing is recorded, occurs in the corresponding portion of the recording medium after printing, thus giving rise to a printing defect.

There is a method in which if a nozzle blockage has occurred, then the nozzle blockage is eliminated by using a suction pump or a pressure pump, or the like; however, if the ink has reached a very high viscosity, then it is difficult to eliminate blockages by this means, and consequently, the inkjet head ceases to function.

Therefore, as a method of preventing the evaporation of the solvent in the ink in the vicinity of the nozzles of the inkjet head, a method has been proposed in which humidified air is supplied to and expelled from the vicinity of the nozzles of the inkjet head, thereby keeping the vicinity of the nozzles in a humidified atmosphere (see, e.g., Japanese Patent Application Publication No. 2000-79696).

Moreover, various methods for recovering ink mist have been proposed, which provide technologies which are similar but do not prevent evaporation of the ink solvent (see, e.g., Japanese Patent Application Publication Nos. 2004-330446 and 2004-330615).

However, in Japanese Patent Application Publication No. 2000-79696, as well as supplying humidified air to the vicinity of the nozzles, the humidified air thus supplied is also expelled to the exterior of the apparatus, in order to prevent condensation. Therefore, if the apparatus is driven for a long period of time, then it is necessary to provide a large source of moisture, which is problematic in that it is impractical and increases the size of the apparatus, and furthermore, if the ink solvent, in other words, the moisture source, is an organic solvent such as alcohol, then the organic solvent is expelled to the exterior of the apparatus, which means that a disagreeable smell is generated whenever the apparatus is driven and the health of people in the vicinity may be damaged.

Therefore, Japanese Patent Application Publication No. 2000-79696 discloses that the whole of the head section is covered with a covering. However, when performing printing, the recording medium, such as paper, passes through the interior of the covering, and therefore the recording medium suffers deformation or alteration due to absorbing moisture from the humidified air. Furthermore, there is also a problem in that this also causes bleeding of the ink on the recording medium.

Furthermore, Japanese Patent Application Publication Nos. 2004-330446 and 2004-330615 both have recovery mechanisms only, and they are not directed toward the evaporation of the solvent from the ink.

As described above, methods have been proposed for supplying and expelling humidified air to and from the peripheral region of an inkjet printer head, but they involve many problems and are not practicable.

SUMMARY OF THE INVENTION

The present invention has been contrived in view of the foregoing circumstances, an object thereof being to provide a liquid ejection head which is simple, compact in size and practicable and in which nozzle blockages are not liable to occur, and an image forming apparatus using this liquid ejection head.

In order to attain the aforementioned object, the present invention is directed to a liquid ejection head, comprising: a casing; nozzles which eject droplets of liquid containing a volatile solvent and are arranged on a nozzle face in the casing; an air outlet which supplies an air flow containing a vapor of the volatile solvent and is arranged on an upstream side in the air flow with respect to the nozzle face; an air inlet which recovers the air flow containing the vapor of the volatile solvent supplied from the air outlet and is arranged on the downstream side in the air flow with respect to the nozzle face; and an air flow circulation mechanism including a circulation device which resupplies, from the air outlet, the air flow containing the vapor of the volatile solvent recovered through the air inlet, wherein the air flow containing the vapor of the volatile solvent is circulated inside the casing.

According to this aspect of the present invention, it is possible to circulate the air flow containing the vapor of the volatile solvent generated by the respective nozzles, without having to provide a special mechanism for generating the vapor of the volatile solvent, or the like, and since the solvent vapor pressure increases, then continuous evaporation of solvent from the nozzles is suppressed, and hence the liquid ejection head that is not liable to produce nozzle blockages can be made compact in size. The upstream side means the side where a recording medium enters, when the recording medium is moved relatively with respect to the liquid ejection head, and the downstream side means the side where the recording medium is outputted when the recording medium is moved relatively with respect to the liquid ejection head.

In order to attain the aforementioned object, the present invention is also directed to a liquid ejection head, comprising: nozzles which eject droplets of liquid containing a volatile solvent and are arranged on a nozzle face; an air outlet which supplies an air flow containing a vapor of the volatile solvent and is arranged on an upstream side in the air flow with respect to the nozzle face; an air inlet which recovers the air flow containing the vapor of the volatile solvent supplied from the air outlet and is arranged on the downstream side in the air flow with respect to the nozzle face; and an air flow circulation mechanism including a circulation device which resupplies, from the air outlet, the air flow containing the vapor of the volatile solvent recovered through the air inlet, wherein: a direction of the air flow containing the vapor of the volatile solvent with respect to the nozzle face is same with a direction in which a recording medium which receives recording by the liquid ejection head moves with respect to the liquid ejection head; and a relative speed of the air flow containing the vapor of the volatile solvent with respect to the liquid ejection head, at an interface between the air flow containing the vapor of the volatile solvent and an air flow generated by a relative movement of the recording medium with respect to the liquid ejection head, is within 50% through 120% of a relative speed of the recording medium with respect to the liquid ejection head.

According to this aspect of the present invention, it is possible to make the air flow containing the vapor of the volatile solvent circulate more effectively. Moreover, the occurrence of eddies caused by the air flow passing between the liquid ejection head and the recording medium is prevented, mixing of the respective air flows is prevented, and decline in the solvent vapor pressure in the air flow containing the vapor of the volatile solvent can be prevented more effectively. In the present specification, instead of the term "solvent vapor pressure", the term "humidity" may be used to indicate the vapor pressure in air of the vapor of the solvent contained in various types of inks, including water vapor.

Preferably, before performing image formation with the liquid ejection head, droplets of the liquid are ejected from the nozzles at a slower speed than an ejection speed of droplets of the liquid necessary for the image formation, and the droplets of the liquid are recovered through the air inlet, by means of the air flow supplied from the air outlet.

According to this aspect of the present invention, before printing, the liquid of increased viscosity inside the nozzles is expelled during standby, and during printing, the liquid of increased viscosity can be expelled from the nozzles having a low frequency of use, and furthermore, the volatile solvent of the expelled liquid can be recovered, circulated, and supplied from the air outlet. Therefore, it is possible to increase the solvent vapor pressure in the air flow containing the vapor of the volatile solvent, as well as being able to dispose of the ink of increased viscosity.

Preferably, the liquid ejection head further comprises: a vapor density measurement device which measures a density of the vapor of the volatile solvent in the air flow containing the vapor of the volatile solvent, in a circulation path of the air flow containing the vapor of the volatile solvent inside the air flow circulation mechanism; and a volatile solvent vapor generation device which generates the vapor of the volatile solvent and is arranged in the air flow circulation mechanism, wherein the density of the vapor of the volatile solvent in the air flow containing the vapor of the volatile solvent is maintained at a prescribed value by generating the vapor of the volatile solvent by means of the volatile solvent vapor generation device, in accordance with measurement results obtained from the vapor density measurement device.

According to this aspect of the present invention, even if the solvent vapor pressure in the ambient atmosphere of the liquid ejection head is low, it is possible to quickly raise the solvent vapor pressure of the air flow containing the vapor of the volatile solvent, and it is possible to uniformly maintain a prescribed solvent vapor pressure.

Preferably, the liquid ejection head further comprises: an air flow temperature measurement device which measures a temperature of the air flow containing the vapor of the volatile solvent, in a circulation path of the air flow containing the vapor of the volatile solvent inside the air flow circulation mechanism; and an air flow temperature adjustment device which adjusts the temperature of the air flow containing the vapor of the volatile solvent and is arranged in the air flow circulation mechanism, wherein the temperature of the air flow containing the vapor of the volatile solvent is maintained at a prescribed value by means of the air flow temperature adjustment device, in accordance with measurement results obtained from the air flow temperature measurement device.

According to this aspect of the present invention, it is possible to maintain the temperature of the air flow containing the vapor of the volatile solvent at a uniform temperature, and it is possible to maintain the saturation vapor pressure of the solvent at a uniform pressure. Furthermore, it is also possible to prevent condensation caused by a fall in the temperature of the ambient atmosphere of the liquid ejection head.

Preferably, the liquid ejection head further comprises: a volatile solvent vapor generation device which generates the vapor of the volatile solvent and is arranged in the air flow circulation mechanism; an air flow temperature measurement device which measures a temperature of the air flow containing the vapor of the volatile solvent, in a circulation path of the air flow containing the vapor of the volatile solvent inside the air flow circulation mechanism; and an air flow temperature adjustment device which adjusts the temperature of the air flow containing the vapor of the volatile solvent and is arranged in the air flow circulation mechanism, wherein: the temperature of the air flow containing the vapor of the volatile solvent is maintained at a prescribed value by means of the air flow temperature adjustment device, in accordance with measurement results obtained from the air flow temperature measurement device; and the circulation device, the volatile solvent vapor generation device, the air flow temperature adjustment device and the air flow temperature measurement device are arranged in this order in a direction from the air inlet toward the air outlet inside the air flow circulation mechanism.

According to this aspect of the present invention, it is possible to make the air flow generated by the circulation device come into direct contact with the volatile solvent vapor generation device and the air flow temperature adjustment device, and therefore the generation of vapor and the temperature adjustment can be performed more efficiently. Moreover, it is possible to maintain the temperature of the air flow containing the vapor of the volatile solvent at a uniform temperature, and it is possible to maintain the saturation vapor pressure of the solvent at a uniform pressure. Furthermore, it is also possible to prevent condensation caused by a fall in the temperature of the ambient atmosphere of the liquid ejection head.

Preferably, the liquid ejection head further comprises: a vapor density measurement device which measures a density of the vapor of the volatile solvent in the air flow containing the vapor of the volatile solvent, in a circulation path of the air flow containing the vapor of the volatile solvent inside the air flow circulation mechanism; a volatile solvent vapor generation device which generates the vapor of the volatile solvent and is arranged in the air flow circulation mechanism; and an air flow temperature adjustment device which adjusts the temperature of the air flow containing the vapor of the volatile solvent and is arranged in the air flow circulation mechanism, wherein: the density of the vapor of the volatile solvent in the air flow containing the vapor of the volatile solvent is maintained at a prescribed value by generating the vapor of the volatile solvent by means of the volatile solvent vapor generation device, in accordance with measurement results obtained from the vapor density measurement device; and the circulation device, the volatile solvent vapor generation device, the air flow temperature adjustment device and the vapor density measurement device are arranged in this order in a direction from the air inlet toward the air outlet inside the air flow circulation mechanism.

According to this aspect of the present invention, it is possible to make the air flow generated by the circulation device come into direct contact with the volatile solvent vapor generation device and the air flow temperature adjustment device, and therefore the generation of vapor and the temperature adjustment can be performed more efficiently. Furthermore, even if the solvent vapor pressure in the ambient atmosphere of the liquid ejection head is low, it is possible to quickly raise the solvent vapor pressure of the air flow containing the vapor of the volatile solvent, and it is possible to uniformly maintain a prescribed solvent vapor pressure.

Preferably, the liquid ejection head further comprises: a volatile solvent vapor generation device which generates the vapor of the volatile solvent and is arranged in the air flow circulation mechanism; an air flow temperature measurement device which measures a temperature of the air flow containing the vapor of the volatile solvent, in a circulation path of the air flow containing the vapor of the volatile solvent inside the air flow circulation mechanism; and an air flow temperature adjustment device which adjusts the temperature of the air flow containing the vapor of the volatile solvent and is arranged in the air flow circulation mechanism, the air flow temperature adjustment device including a heating device and a cooling device which heat and cool the air flow containing the vapor of the volatile solvent, wherein: the temperature of the air flow containing the vapor of the volatile solvent is maintained at a prescribed value by means of the air flow temperature adjustment device, in accordance with measurement results obtained from the air flow temperature measurement device; and the circulation device, the heating device of the air flow temperature adjustment device, the volatile solvent vapor generation device, the cooling device of the air flow temperature adjustment device and the air flow temperature measurement device are arranged in this order in a direction from the air inlet toward the air outlet inside the air flow circulation mechanism.

According to this aspect of the present invention, it is possible to make the air flow generated by the circulation device come into direct contact with the volatile solvent vapor generation device and the air flow temperature adjustment device, and therefore the generation of vapor and the temperature adjustment can be performed more efficiently. Moreover, it is possible to maintain the temperature of the air flow containing the vapor of the volatile solvent at a uniform temperature, and to maintain the saturation vapor pressure of the solvent at a uniform pressure, as well as being able readily to supply the air flow of solvent vapor which is close to a saturated state. Furthermore, it is also possible to prevent condensation caused by a fall in the temperature of the ambient atmosphere of the liquid ejection head.

Preferably, the liquid ejection head further comprises: a vapor density measurement device which measures a density of the vapor of the volatile solvent in the air flow containing the vapor of the volatile solvent, in a circulation path of the air flow containing the vapor of the volatile solvent inside the air flow circulation mechanism; a volatile solvent vapor generation device which generates the vapor of the volatile solvent and is arranged in the air flow circulation mechanism; and an air flow temperature adjustment device which adjusts the temperature of the air flow containing the vapor of the volatile solvent and is arranged in the air flow circulation mechanism, the air flow temperature adjustment device including a heating device and a cooling device which heat and cool the air flow containing the vapor of the volatile solvent, wherein: the density of the vapor of the volatile solvent in the air flow containing the vapor of the volatile solvent is maintained at a prescribed value by generating the vapor of the volatile solvent by means of the volatile solvent vapor generation device, in accordance with measurement results obtained from the vapor density measurement device; and the circulation device, the heating device of the air flow temperature adjustment device, the volatile solvent vapor generation device, the cooling device of the air flow temperature adjustment device and the vapor density measurement device are arranged in this order in a direction from the air inlet toward the air outlet inside the air flow circulation mechanism.

According to this aspect of the present invention, it is possible to make the air flow generated by the circulation device come into direct contact with the volatile solvent vapor generation device and the air flow temperature adjustment device, and therefore the generation of vapor and the temperature adjustment can be performed more efficiently. Moreover, it is possible to quickly raise the solvent vapor pressure of the air flow containing the vapor of the volatile solvent, as well as being able readily to supply the air flow of solvent vapor which is close to a saturated state. Furthermore, even if the solvent vapor pressure in the ambient atmosphere of the liquid ejection head is low, it is possible to uniformly maintain a prescribed solvent vapor pressure.

Preferably, a partial pressure of the volatile solvent in the air flow containing the vapor of the volatile solvent is within 80% through 100% of a saturation vapor pressure of the volatile solvent in the air flow containing the vapor of the volatile solvent around the nozzles.

According to this aspect of the present invention, it is possible effectively to prevent evaporation of the volatile solvent in the ink in the nozzles, while preventing condensation of the volatile solvent in the vicinity of the head.

Preferably, the liquid ejection head further comprises: an air flow adjusting mechanism including a component member through which a plane passes, the plane being obtained by extending an interface between the air flow containing the vapor of the volatile solvent and an air flow generated by a relative movement of a recording medium with respect to the liquid ejection head, the recording medium receiving recording by the liquid ejection head, the component member having a face parallel with the plane, wherein the air flow adjusting mechanism has an end on a side close to the nozzles and an end on a side distant from the nozzles, the end on the side close to the nozzles having a shape acuter than the end on the side distant from the nozzles.

According to this aspect of the present invention, it is possible to make the air flow containing the vapor of the volatile solvent flow at high speed, with little turbulence in the vicinity of the nozzles. Moreover, the occurrence of eddies caused by the air flow passing between the liquid ejection head and the recording medium is prevented, mixing of the respective air flows is prevented, decline in the solvent vapor pressure in the air flow containing the vapor of the volatile solvent can be prevented more effectively.

Preferably, a pressure at the air inlet is lower than atmospheric pressure.

According to this aspect of the present invention, it is possible further to improve the efficiency of recovery of the air flow containing the vapor of the volatile solvent.

Preferably, after performing image formation with the liquid ejection head for prescribed duration, droplets of the liquid are ejected from the nozzles at a slower speed than an ejection speed of droplets of the liquid necessary for the image formation, and the droplets of the liquid are recovered through the air inlet, by means of the air flow supplied from the air outlet.

According to this aspect of the present invention, it is possible to purge ink of increased viscosity and therefore to prevent nozzle blockages, without using an ink receptacle as in the related art. Moreover, in a single pass fixed head apparatus, it is possible to purge the ink during printing.

Preferably, from at least one of the nozzles that ejects droplets of the liquid not more than prescribed volume per prescribed duration, droplets of the liquid are ejected at a slower speed than an ejection speed of droplets of the liquid necessary for performing image formation with the liquid ejection head, and the droplets of the liquid are recovered through the air inlet, by means of the air flow supplied from the air outlet.

According to this aspect of the present invention, it is possible to purge ink of increased viscosity and therefore to prevent nozzle blockages, without using an ink receptacle as in the related art. Moreover, even in a state where ink is purged from liquid ejection nozzles that have not performed ejection at all during a prescribed period of time, it is still possible to continue the ejection of liquid droplets for printing from the other nozzles.

Preferably, the liquid ejection head further comprises: a liquid droplet charging device which applies electric charges to the droplets of the liquid; and a liquid droplet attraction device which is arranged around the air inlet, wherein the charged droplets of the liquid are attracted by applying an electric field to the liquid droplet attraction device.

According to this aspect of the present invention, it is possible to recover the ink ejected from the nozzles more reliably, it is possible to raise the solvent vapor pressure of the circulating air flow, then it is possible to effectively prevent nozzle blockages.

Preferably, the liquid ejection head further comprises: a liquid droplet attraction device which is arranged around the air inlet, wherein an electric potential difference is applied between the nozzles and the liquid droplet attraction device.

According to this aspect of the present invention, it is possible to recover the ink ejected from the nozzles more reliably, and it is also possible to effectively prevent nozzle blockages.

In order to attain the aforementioned object, the present invention is also directed to an image forming apparatus comprising the above-described liquid ejection head.

According to this aspect of the present invention, it is possible to perform printing that is free of quality defects, over a long period of time.

In the liquid ejection head according to the present invention, beneficial effects are obtained in that it is possible to reduce nozzle blockages by means of a structure that is simple, compact and practical.

Furthermore, in an image forming apparatus equipped with this liquid ejection head, beneficial effects are obtained in that image faults do not occur and printing which is free of quality defects can be performed over a long period of time.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
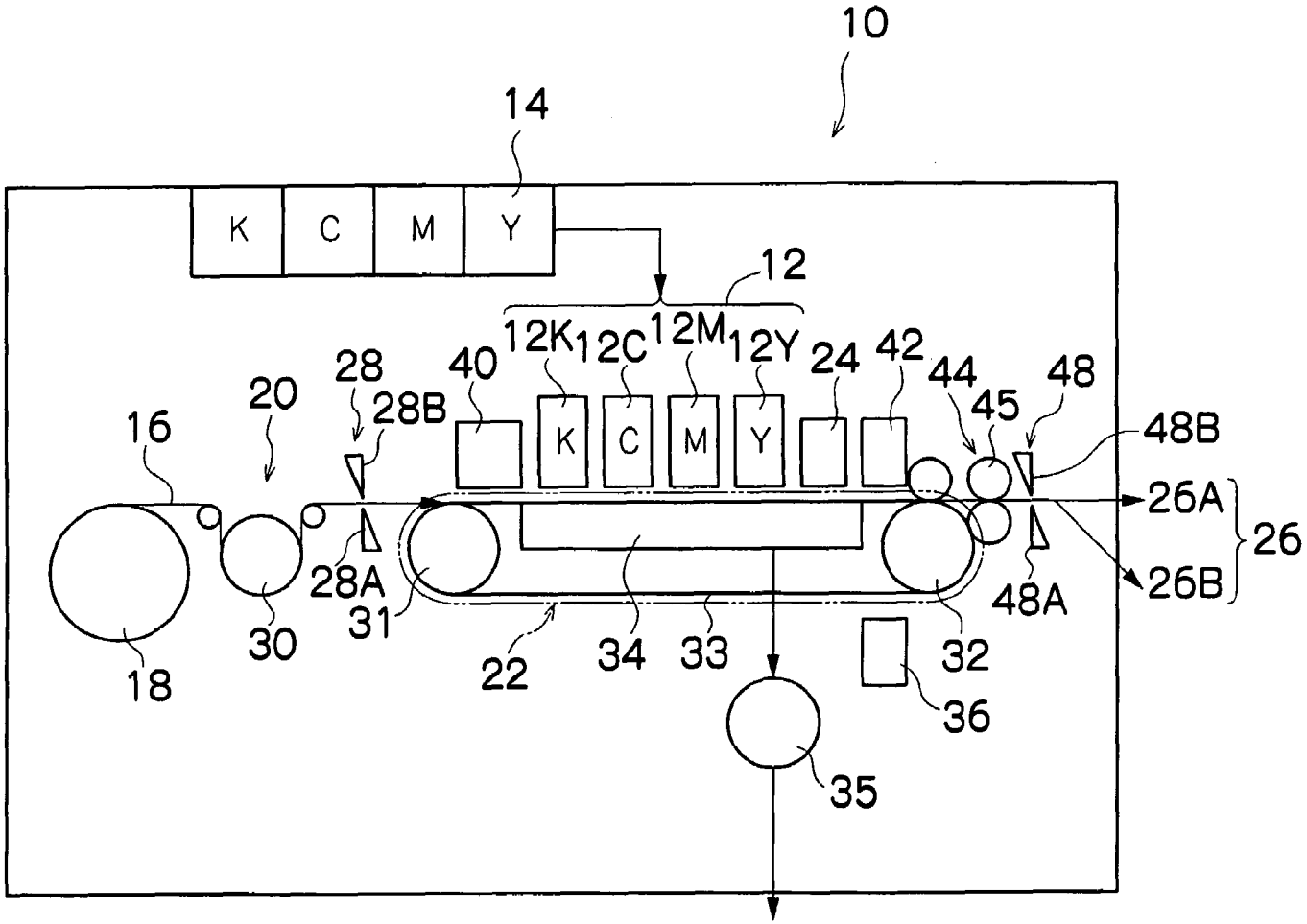
FIG. 1 is a general schematic drawing of an inkjet recording apparatus which forms an image forming apparatus according to an embodiment of the present invention.

FIG. 1 is a general schematic drawing showing an approximate view of an image forming apparatus comprising an inkjet head (liquid ejection head) according to the present invention.

As shown in FIG. 1, the inkjet recording apparatus 10 includes: a printing unit 12 having a plurality of print heads (liquid ejection heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the belt conveyance unit 22. The belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane (flat plane).

There are no particular limitations on the structure of the belt conveyance unit 22, and it may use vacuum suction conveyance in which the recording paper 16 is conveyed by being suctioned onto the belt 33 by negative pressure created by suctioning air through suction holes provided on the belt surface, or it may be based on electrostatic attraction.

The belt 33 has a width dimension that is broader than the width of the recording paper 16, and in the case of the vacuum suction conveyance method described above, a plurality of suction holes (not illustrated) are formed in the surface of the belt. A suction chamber 34 is disposed in a position facing the sensor surface of the print determination unit 24 and the nozzle face of the printing unit 12 on the interior side of the belt 33, which is set around the rollers 31 and 32, as shown in FIG. 1; and this suction chamber 34 provides suction with a fan 35 to generate a negative pressure, thereby holding the recording paper 16 onto the belt 33 by suction.

The belt 33 is driven in the clockwise direction in FIG. 1 by the motive force of a motor (not shown in drawings) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the belt conveyance unit 22. The heating fan 40 blows heated air onto the recording paper 16 to heat the recording paper 16 immediately before printing so that the ink deposited on the recording paper 16 dries more easily.

Figure 2:
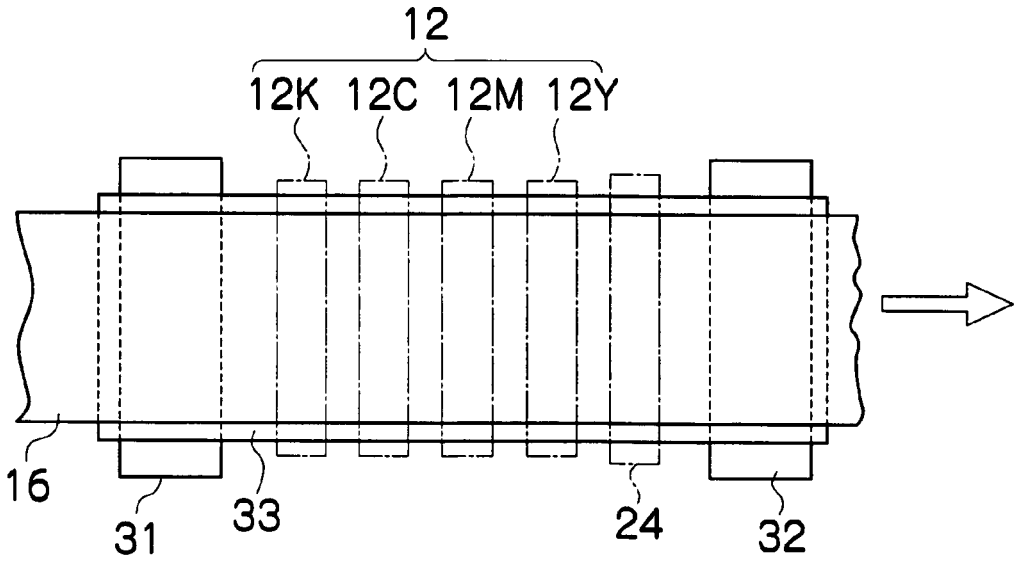
FIG. 2 is a principal plan diagram showing the peripheral area of a print unit of the inkjet recording apparatus.

FIG. 2 is a principal plan diagram showing the periphery of the print unit 12 in the inkjet recording apparatus 10.

As shown in FIG. 2, the print unit 12 is a so-called "full line head" in which a line head having a length corresponding to the maximum paper width is arranged in a direction (main scanning direction) that is perpendicular to the paper conveyance direction (sub scanning direction).

Each of the print heads 12K, 12C, 12M, and 12Y is constituted by a line head, in which a plurality of ink ejection ports (nozzles) are arranged along a length that exceeds at least one side of the maximum-size recording paper 16 intended for use in the inkjet recording apparatus 10.

The print heads 12K, 12C, 12M, and 12Y are arranged in the order of black (K), cyan (C), magenta (M), and yellow (Y) from the upstream side (left side in FIG. 1), along the conveyance direction of the recording paper 16 (paper conveyance direction). A color image can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in a direction (main scanning direction) that is perpendicular to the paper conveyance direction.

Here, the terms main scanning direction and sub-scanning direction are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning action, while moving the full-line head and the recording paper relatively to each other. The direction in which sub-scanning is performed is called the sub-scanning direction. Consequently, the conveyance direction of the recording paper is the sub-scanning direction and the direction perpendicular to same is called the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator or the like) for warning when the remaining amount of any ink is low, and has a mechanism for preventing loading errors among the colors.

The print determination unit 24 has an image sensor (line sensor, or the like) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in drawings, the paper output unit 26A for the target prints is provided with a sorter for collecting prints according to print orders.

Figure 3:
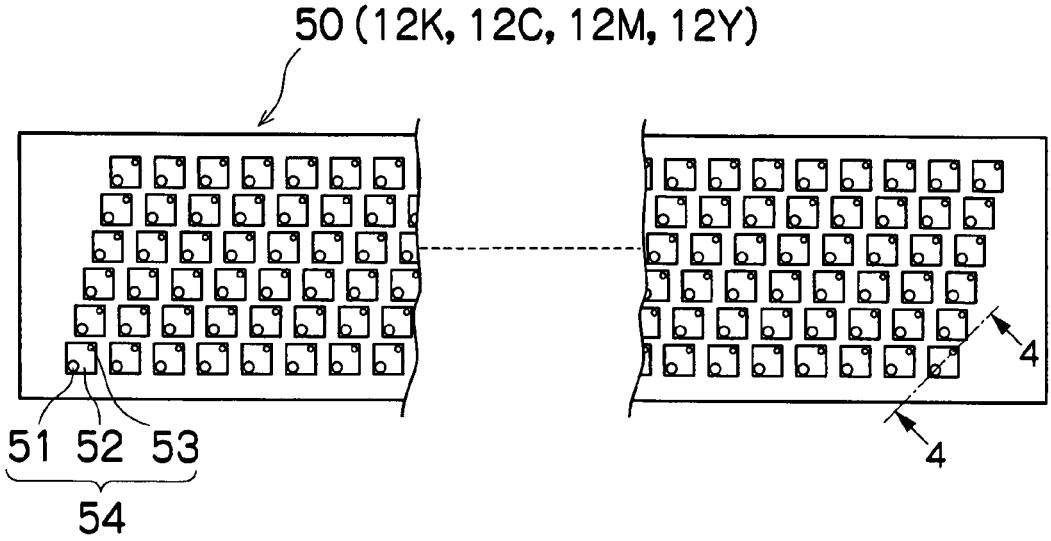
FIG. 3 is a plan view perspective diagram showing an embodiment of the composition of a print head in the inkjet recording apparatus.

Next, the arrangement of nozzles (liquid ejection ports) in the print head (liquid ejection head) will be described. The print heads 12K, 12C, 12M and 12Y provided for the respective ink colors each have the same structure, and a print head forming a representative embodiment of these print heads is indicated by the reference numeral 50. FIG. 3 shows a plan view perspective diagram of the print head 50.

As shown in FIG. 3, the print head 50 according to the present embodiment achieves a high density arrangement of nozzles 51 by using a two-dimensional staggered matrix array of pressure chamber units 54, each constituted by a nozzle for ejecting ink as ink droplets, a pressure chamber 52 for applying pressure to the ink in order to eject ink, and an ink supply port 53 for supplying ink to the pressure chamber 52 from a common liquid chamber (not shown in FIG. 3).

In the embodiment shown in FIG. 3, the pressure chambers 52 each have an approximately square planar shape when viewed from above, but the planar shape of the pressure chambers 52 is not limited to a square shape. As shown in FIG. 3, a nozzle 51 is formed at one end of a diagonal of each pressure chamber 52, and an ink supply port 53 is provided at the other end thereof.

Furthermore, although not shown in the drawings, it is also possible that one long full line head is constituted by combining a plurality of short heads arranged in a two-dimensional staggered array, in such a manner that the combined length of this plurality of short heads corresponds to the full width of the print medium.

Figure 4:
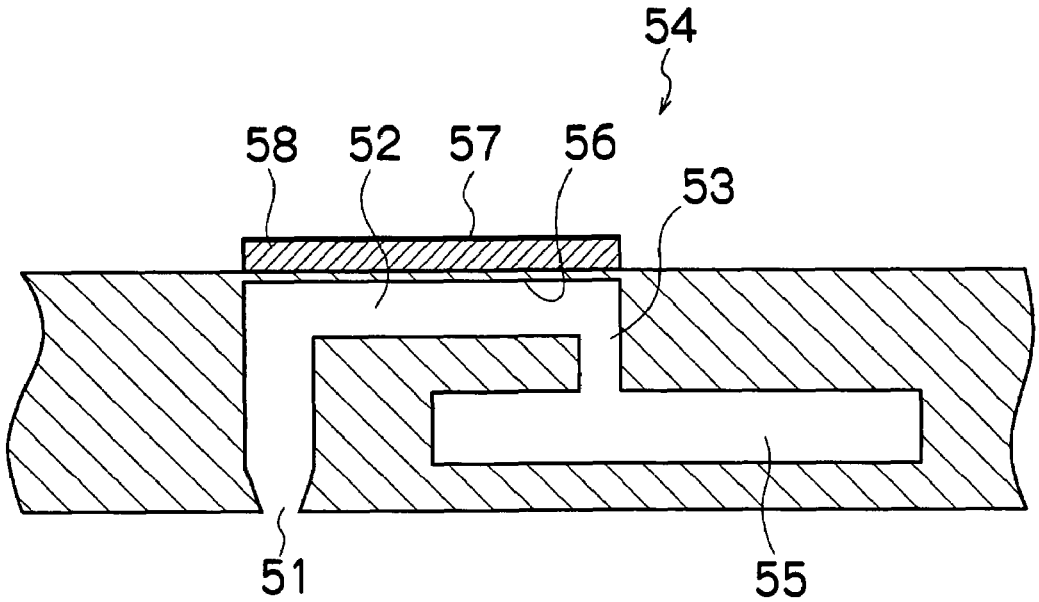
FIG. 4 is a cross-sectional diagram along line 4-4 in FIG. 3.

FIG. 4 shows a cross-sectional diagram along line 4-4 in FIG. 3.

As shown in FIG. 4, the pressure chamber unit 54 is formed by a pressure chamber unit 52 connected to a nozzle 51 which ejects ink, and it is also connected to a common liquid chamber 55 which supplies ink through a supply port 53. Furthermore, one surface (in FIG. 4, the ceiling) of the pressure chamber 52 is constituted by a diaphragm 56, and a piezoelectric element 58 which causes the diaphragm 56 to deform by applying a pressure to the diaphragm 56 is bonded on top of the diaphragm 56. An individual electrode 57 is formed on the upper surface of the piezoelectric element 58. Furthermore, the diaphragm 56 also serves as a common electrode.

The piezoelectric element 58 is sandwiched between the common electrode (diaphragm 56) and the individual electrode 57, and it deforms when a drive voltage is applied between the common electrode (diaphragm 56) and the individual electrode 57. The diaphragm 56 is pressed by the deformation of the piezoelectric element 58, in such a manner that the volume of the pressure chamber 52 is reduced and ink is ejected from the nozzle 51. When the voltage applied between the common electrode (diaphragm 56) and the individual electrode 57 is released, the piezoelectric element 58 returns to its original position, the volume of the pressure chamber 52 returns to its original size, and new ink is supplied into the pressure chamber 52 from the common liquid channel 55 and through the supply port 53.

Figure 5:
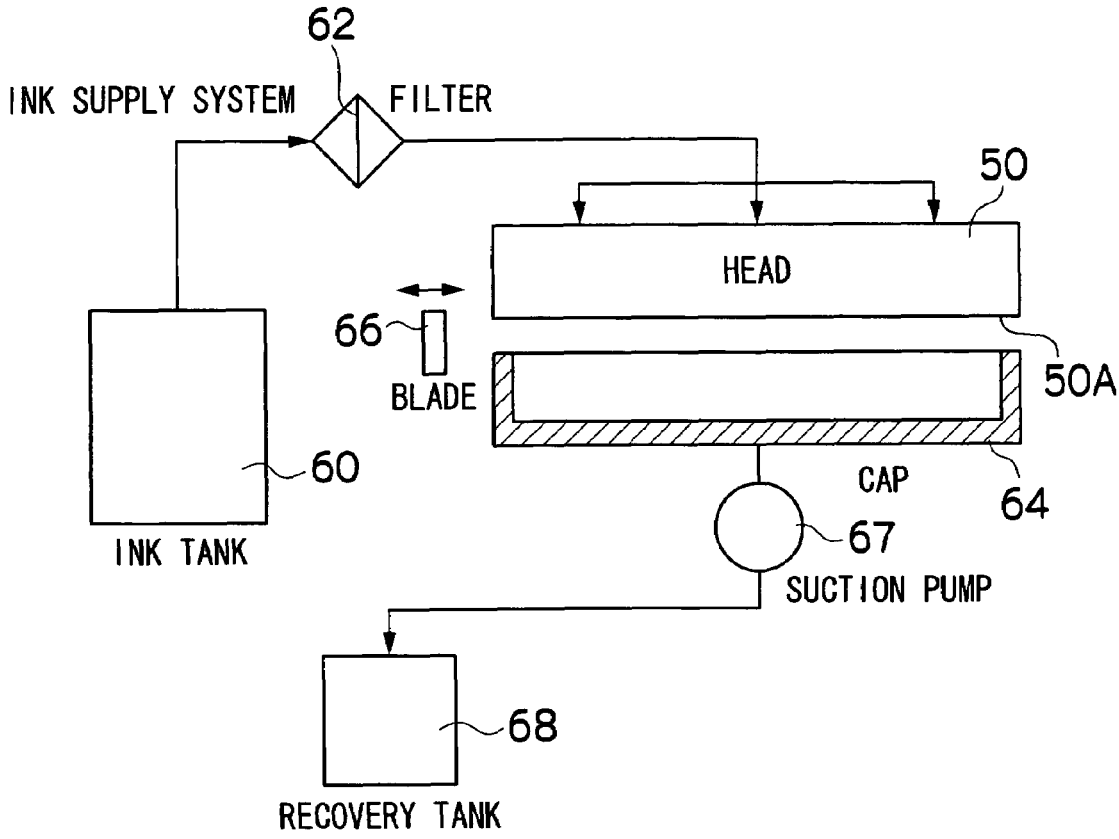
FIG. 5 is a schematic drawing showing an approximate view of an ink supply system in the inkjet recording apparatus.

FIG. 5 is a schematic drawing showing the configuration of the ink supply system in the inkjet recording apparatus 10. The ink tank 60 is a base tank that supplies ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 5 is equivalent to the ink storing and loading unit 14 in FIG. 1 described above.

A filter 62 for removing foreign matters and bubbles is disposed in the middle of the channel connecting the ink tank 60 and the print head 50 as shown in FIG. 5. The filter mesh size in the filter 62 is preferably equivalent to or less than the diameter of the nozzle of the print head 50 and commonly about 20 μm.

Although not shown in FIG. 5, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles from drying out or to prevent an increase in the ink viscosity in the vicinity of the nozzles 51, and a cleaning blade 66 as a device to clean the nozzle face 50A.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power is turned OFF or when in a print standby state, the elevator mechanism raises the cap 64 to a predetermined elevated position so as to come into close contact with the print head 50, and the nozzle region of the nozzle face 50A is thereby covered with the cap 64.

The cleaning blade 66 is composed of rubber or another elastic member, and can slide on the ink ejection surface (nozzle face 50A) of the print head 50 by means of a blade movement mechanism (not shown). If there are ink droplets or foreign matter adhering to the nozzle face 50A, then the nozzle face 50A is wiped by causing the cleaning blade 66 to slide over the nozzle face 50A, thereby cleaning same.

Even if the use frequency of a particular nozzle 51 has fallen during printing, or during standby, and the ink viscosity in the vicinity of the nozzle 51 has risen, according to the embodiment of the present invention described below, it is still possible to expel the ink that has become degraded by increasing in viscosity. Furthermore, as and when required, it is also possible to carry out preliminary ejection toward the cap 64 as usual.

Moreover, when bubbles have become intermixed into the ink inside the print head 50 (the ink inside the pressure chambers 52), the cap 64 is placed on the print head 50, ink (ink in which bubbles have become intermixed) inside the pressure chambers 52 is removed by suction with a suction pump 67, and the ink removed by suction is sent to a recovery tank 68. This suction operation is also carried out selectively in order to suction and remove degraded ink which has hardened due to increasing in viscosity, when ink is loaded into the print head for the first time, and when the print head starts to be used after having been out of use for a long period of time.

In other words, when a state in which ink is not ejected from the print head 50 continues for a certain amount of time or longer, the ink solvent in the vicinity of the nozzles 51 evaporates and the ink viscosity increases. In such a state, ink can no longer be ejected from the nozzles 51 even if the actuators (laminated piezoelectric elements 58) for driving ejection are operated. Therefore, before reaching such a state (in other words, while the ink viscosity is within a range that allows ejection by the operation of the laminated piezoelectric elements 58), the ink that has become degraded due to increasing in viscosity is expelled according to the embodiment of the present invention described below, or alternatively, the laminated piezoelectric elements 58 are operated toward the ink receptacle, thus performing a "preliminary ejection" which causes the ink in the vicinity of the nozzles whose viscosity has increased to be ejected. With regard to whether to carry out the present invention described below or whether to perform ejection toward the ink receptacle, in a case where, for example, the ink viscosity has become fairly high and has reached a viscosity higher than that envisaged in the embodiment of the present invention described below, then ejection should be performed toward the ink receptacle as described previously, but prior to reaching a state of this kind, it is desirable from the viewpoint of throughput to implement the embodiment of the present invention described below. Furthermore, after cleaning away soiling on the surface of the nozzle face 50A by means of a wiper, such as a cleaning blade 66, provided as a cleaning device on the nozzle face 50A, a preliminary ejection is also carried out in order to prevent infiltration of foreign matter into the nozzles 51 due to the rubbing action of the wiper. The preliminary ejection is also referred to as "dummy ejection", "purge", "liquid ejection", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink inside the nozzles 51 and the pressure chambers 52, or when the ink viscosity in the nozzles 51 has increased to a certain level or greater, ink can no longer be ejected from the nozzles 51 even if the laminated piezoelectric elements 58 are operated. In a case of this kind, a cap 64 is placed on the nozzle face 50A of the print head 50, and the ink containing air bubbles or the ink of increased viscosity inside the pressure chambers 52 is suctioned by a pump 67.

However, this suction action is performed with respect to all of the ink in the pressure chambers 52, and therefore the amount of ink consumption is considerable. Therefore, wherever possible, in cases where the increase in viscosity is small, it is desirable to expel ink according to the embodiment of the present invention described below. The cap 64 illustrated in FIG. 5 functions as a suctioning device and it may also function as an ink receptacle for preliminary ejection.

Moreover, desirably, the inside of the cap 64 is divided by means of partitions into a plurality of areas corresponding to the nozzle rows, thereby achieving a composition in which suction can be performed selectively in each of the demarcated areas, by means of a selector, or the like.

Figure 6:
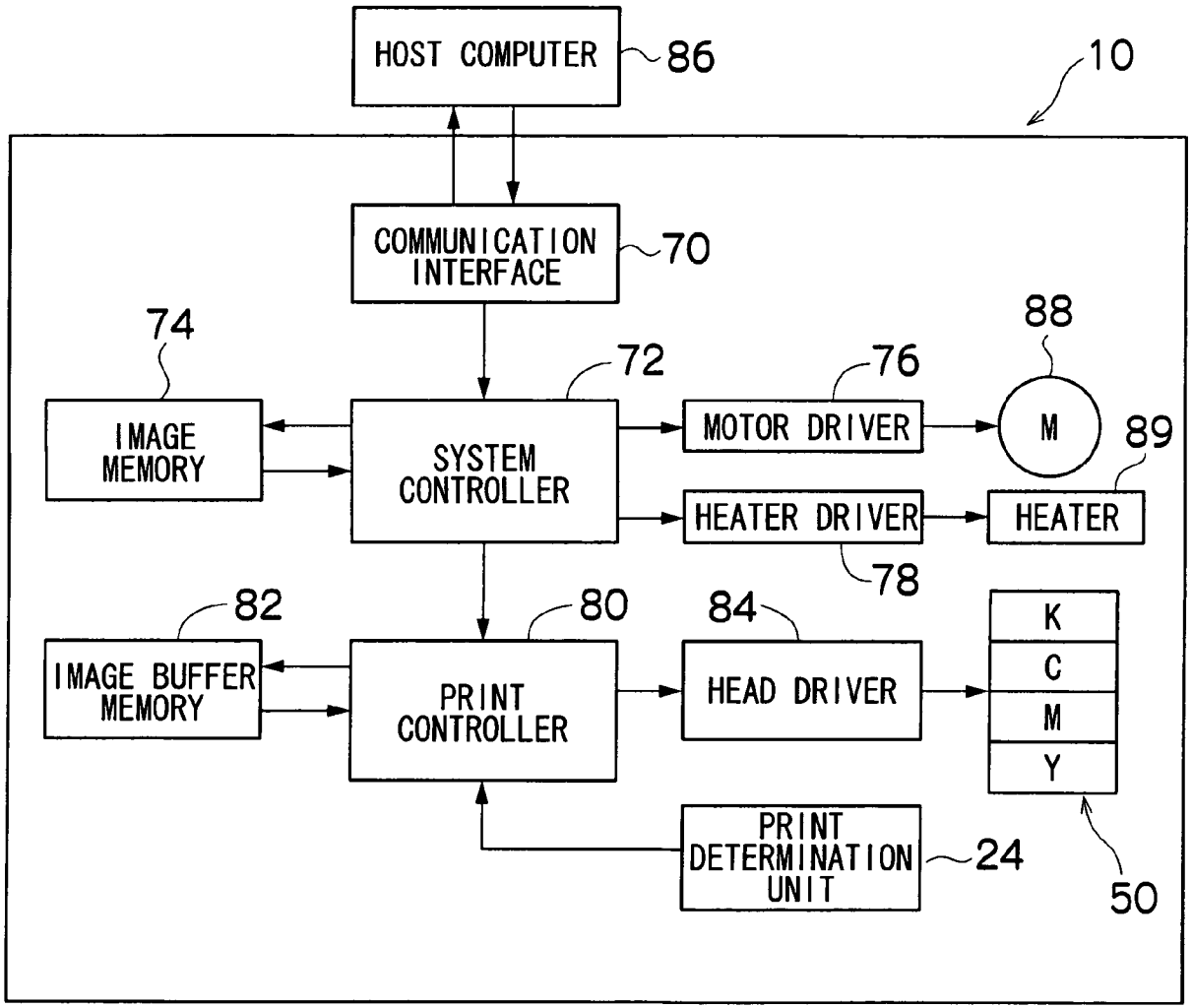
FIG. 6 is a block diagram showing the system composition of the inkjet recording apparatus.

FIG. 6 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet (registered trademark), wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communication interface 70, the image memory 74, the motor driver 76, the heater driver 78, and the like. The system controller 72 is constituted by a central processing unit (CPU) and peripheral circuits thereof, and the like, and in addition to controlling communication with the host computer 86 and controlling reading and writing from and to the image memory 74, or the like, it also generates a control signal for controlling the motor 88 of the conveyance system and the heater 89.

The motor driver 76 drives the motor 88 in accordance with commands from the system controller 72. The heater driver 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (dot data) to the head driver 84. Prescribed signal processing is carried out in the print controller 80, and the ejection amount and the ejection timing of the ink droplets from the respective print heads 50 are controlled through the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 6 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 58 of the print head 50 on the basis of print data supplied by the print controller 80. The head driver 84 can be provided with a feedback control system for maintaining constant drive conditions for the print heads.

The print determination unit 24 is a block that includes the line sensor (not shown) as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the print head 50 on the basis of information obtained from the print determination unit 24.

Next, a first embodiment of a liquid ejection head according to the present invention is described with reference to FIG. 7.

The whole of the liquid ejection head apart from the surface opposing the recording medium 106, such as paper, is covered with a casing 100, and an air flow containing the vapor of the volatile solvent, namely, an air flow containing water vapor, is circulated about the periphery of a head main body 104 inside the casing 100.

In the present embodiment, the ink contains a dye or pigment, other additives, and a solvent composed of glycerin and water in the ratio 4:6. Due to the properties of the mixture of glycerin and water, this ink has a saturated state at approximately 86% RH, and the humidity of the air flow containing water vapor, which is the air flow containing the vapor of the volatile solvent, desirably has as high a humidity as possible without causing condensation; preferably, the humidity is 80% through 100%, and more preferably 80% through 90%.

The air flow containing the vapor of the volatile solvent is supplied from an air outlet 101, and the flow is changed from the side face to the front surface of the head main body 104 by means of an air flow adjusting mechanism 107 provided in the casing 100. Nozzles 105 are provided on the front surface of the head main body 104, and the air flow containing the vapor of the volatile solvent flows over the front surface of the head main body 104 in such a manner that the volatile solvent component in the ink in the nozzles 105 does not evaporate. The air flow containing the vapor of the volatile solvent which flows over the front surface of the head main body 104 is subsequently changed to flow along the side face of the head main body 104 and is recovered through an air inlet 102. The air flow containing the vapor of the volatile solvent recovered through the air inlet 102 is supplied again from the air outlet 101, by means of the air flow circulation mechanism 103.

The recording medium 106 is conveyed in the same direction as the direction of the air flow containing the vapor of the volatile solvent over the surface where the nozzles 105 are arranged. In this case, if the relative speed of the air flow containing the vapor of the volatile solvent with respect to the liquid ejection head, and the relative speed of the recording medium 106 with respect to the liquid ejection head are substantially the same, then there is no intermingling between the air flow containing the vapor of the volatile solvent and the air flow generated by the relative movement of the recording medium 106 with respect to the liquid ejection head. Consequently, virtually all of the air flow containing the vapor of the volatile solvent is retained and circulated within the casing 100 of the liquid ejection head.

The greater the differential between the relative speed of the air flow containing the vapor of the volatile solvent with respect to the liquid ejection head and the relative speed of the recording medium 106 with respect to the liquid ejection head, the greater the tendency of the air flow containing the vapor of the volatile solvent to leak outside the casing 100 of the liquid ejection head. Therefore, desirably, the relative speed of the air flow containing the vapor of the volatile solvent with respect to the liquid ejection head is approximately 50% to 120% of the relative speed of the recording medium 106 with respect to the liquid ejection head. More specifically, the relative speed of the air flow containing the vapor of the volatile solvent considered here is determined at an interface between the air flow containing the vapor of the volatile solvent and an air flow that is generated by the relative movement of the recording medium 106 with respect to the liquid ejection head. Provided that the relative speed of the air flow containing the vapor of the volatile solvent is within this range, then there is no marked leaking of the air flow containing the vapor of the volatile solvent to the outside of the casing 100.

Furthermore, in order to enhance this beneficial effect yet further, the air flow adjusting mechanism 107 has a surface which follows the direction of the air flow at the interface region between the air flow containing the vapor of the volatile solvent and the air flow generated by the relative movement of the recording medium 106 with respect to the liquid ejection head.

Furthermore, by placing the air flow adjusting mechanism 107 and the recording medium 106 as close together as feasibly possible, the space surrounding the casing 100 and the recording medium 106 becomes an almost completely sealed space, and the air flow containing the vapor of the volatile solvent circulates inside this space and hence the air flow containing the vapor of the volatile solvent is prevented from leaking out.

Figure 7:
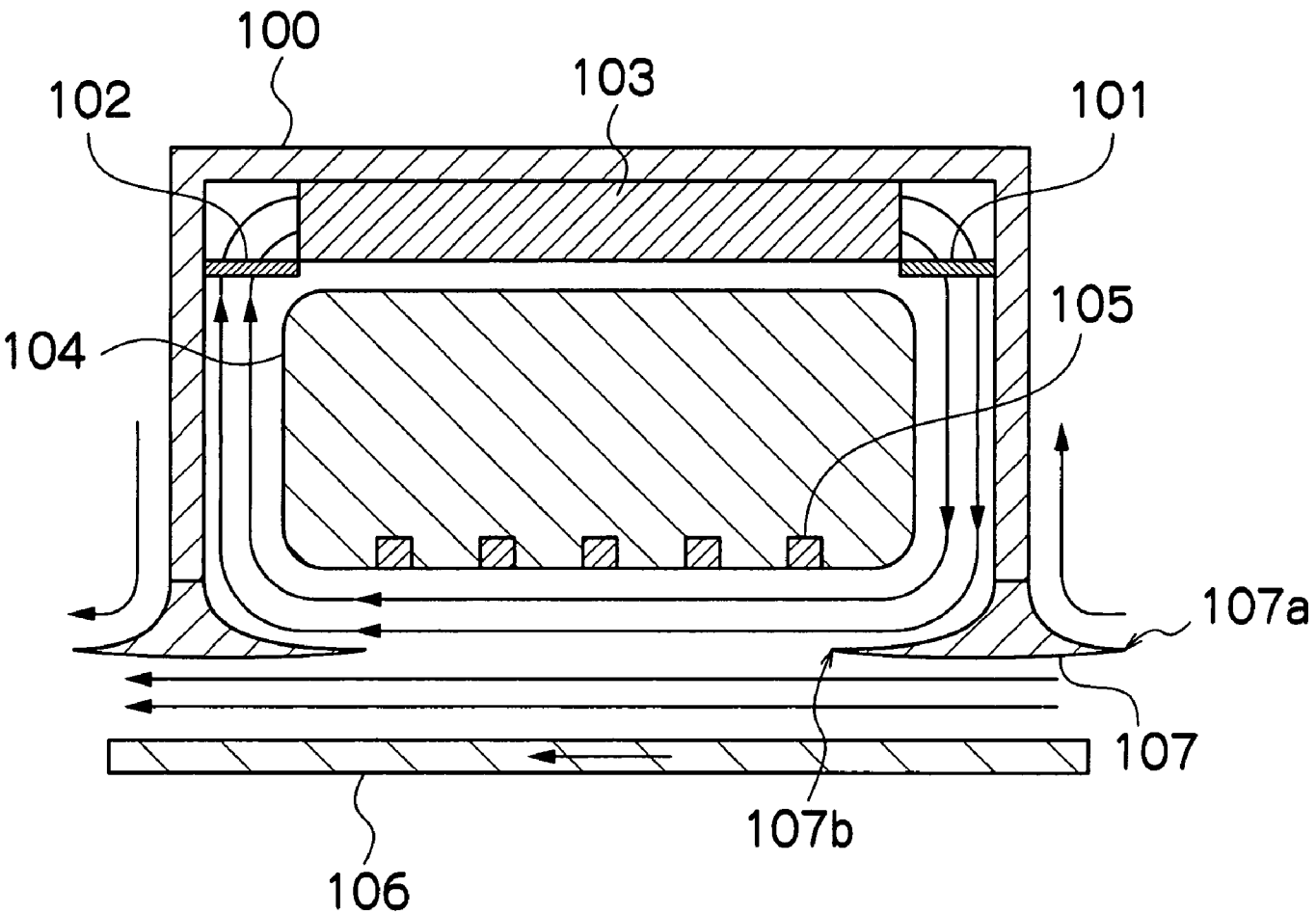
FIG. 7 is a cross-sectional diagram of a liquid ejection head according to a first embodiment of the present invention.

In order to obtain the beneficial effects described above, generally, the air flow adjusting mechanism 107 has an end 107*b* on the side close to the nozzles 105 of the head main body 104 and an end 107*a* on the side distant from the nozzles 105, and the end 107*b* on the side close to the nozzles 105 is formed to a more acute shape than the end 107*a* on the side distant from the nozzles 105, as shown in FIG. 7. By adopting this composition, if an air flow enters in between the recording medium 106 and the surface of the liquid ejection head on which the nozzles 105 are arranged, from the ambient atmosphere outside the casing 100 of the liquid ejection head, due to the movement of the recording medium 106, then there is no significant turbulence of the air flow and it can be made to flow in line with the air flow in the vicinity of the surface where the nozzles 105 are arranged, which air flow is supplied from the air outlet 101, recovered through the air inlet 102 and then circulated. In an opposite case to this composition, although it is not impossible to obtain similar characteristics, the composition is impractical since the end 107*a* on the side that is distant from the nozzles 105 becomes too long, and as a result of this, the apparatus becomes large in size. From the viewpoint of the flow of air, the occurrence of eddies, and air resistance, a desirable composition is one in which the end 107*b* on the side close to the nozzles 105 forms the more acute angle than the end 107*a* on the side that is distant from the nozzles 105.

The air flow supplied from the air outlet 101 and recovered through the air inlet 102 is passed through the air flow circulation mechanism 103 and circulated about the circulation path formed between the casing 100 and the head main body 104. A composition which circulates the air inside the casing 100 of the liquid ejection head in this way is capable of minimizing the length of the circulation path of the air flow. Consequently, it is possible to reduce the volume of the region constituting the circulation path, thus yielding a merit in that good control characteristics can be obtained in the control of the humidity and temperature of the circulating air flow. Furthermore, if a composition is adopted in which a heat pipe 113 forming an air flow temperature adjustment device, a volatile solvent vapor generating device as described below, and an air flow circulation mechanism 103 comprising a fan 114, and the like, are located at distant positions from the liquid ejection head, then the circulation path linking the air flow circulation mechanism 103 with the surface of the liquid ejection head where the nozzles 105 are arranged becomes long, and this may give rise to a fall in the temperature of the air flow inside the circulation path. If the temperature of the air flow declines, then the air flow approaches the saturation humidity and there is a possibility that condensation will occur. Consequently, in this case, it is necessary to provide a composition which covers the circulation path linking the air flow circulation mechanism 103 with the liquid ejection head by means of a member having high thermal insulating properties, or to provide a temperature adjustment mechanism in the circulation path, in order to control the temperature. In the present embodiment, since the air flow is circulated inside the casing 100 of the liquid ejection head, then it is possible to arrange the air flow circulation mechanism 103 and the surface of the liquid ejection head where the nozzles 105 are formed, in the closest relative positions, and consequently there is little possibility of a temperature fall occurring in the air flow inside the circulation path.

Next, the interior of the air flow circulation mechanism 103 is described with reference to FIG. 10.

Figure 10:
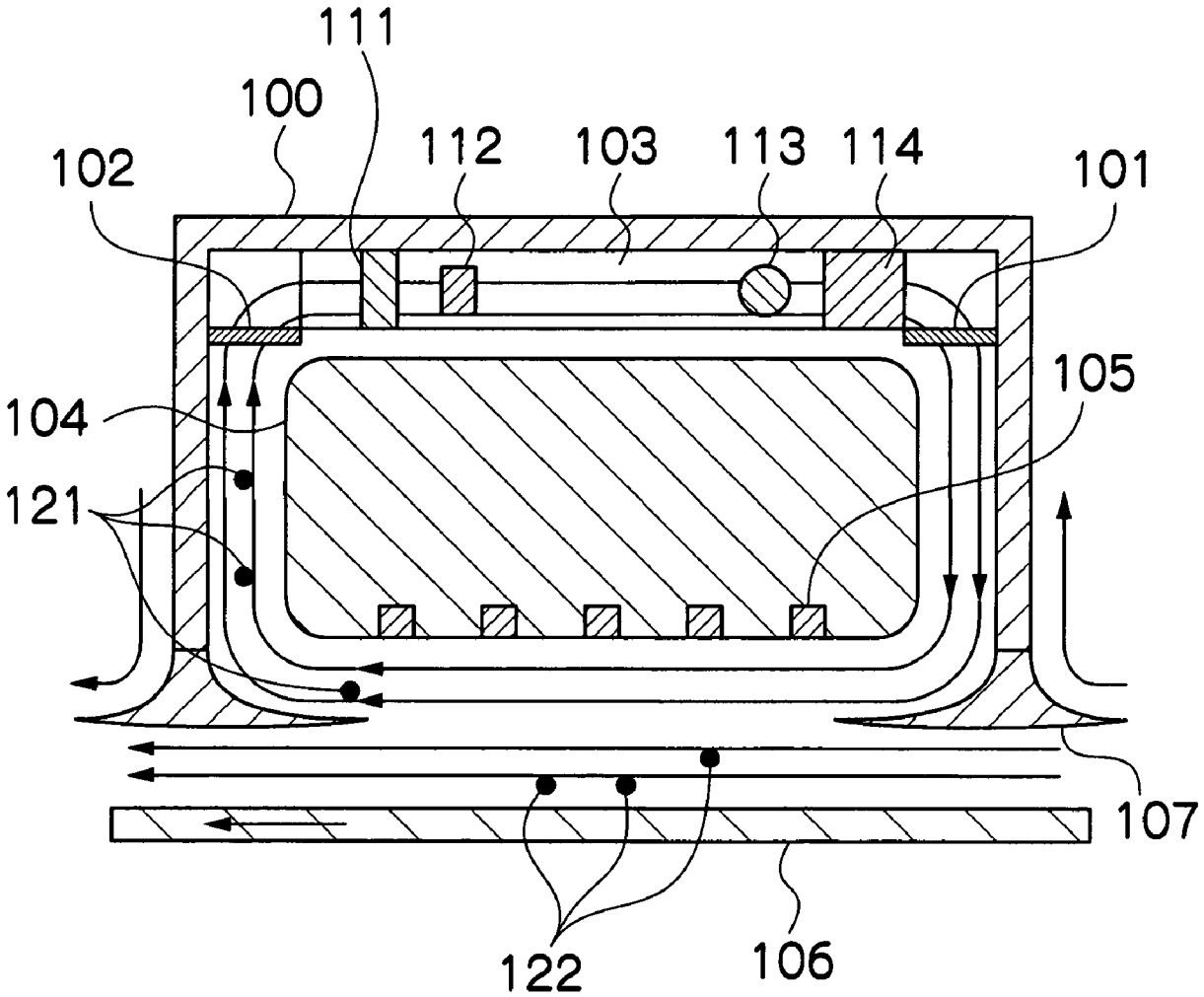
FIG. 10 is a partially transparent cross-sectional diagram of the liquid ejection head according to the first embodiment of the present invention.

FIG. 10 is a cross-sectional diagram of the liquid ejection head in which only the interior of the air flow circulation mechanism 103 is depicted in a transparent fashion.

The air flow containing the vapor of the volatile solvent recovered through the air inlet 102 is passed through a filter 111 provided inside the air flow circulation mechanism 103, thereby removing dust or dirt contained in the air flow. After passing through the filter 111, the air flow is passed in the vicinity of a humidity and temperature sensor 112, which is an air flow temperature measurement device and a vapor density measurement device, and the temperature and the humidity of the air flow are measured. The information obtained by the temperature and humidity sensor 112 is sent to the system controller 72 and the print controller 80 shown in FIG. 6, and the measured values are compared with prescribed temperature and humidity values.

If the temperature of the air flow is lower or higher than the prescribed temperature, then the air flow containing the vapor of the volatile solvent is heated or cooled so as to assume the prescribed temperature, by means of the heat pipe 113, which is an air flow temperature adjustment device provided on the downstream side of the sensor 112. The heat pipe 113 is described as an example of the air flow heating and cooling device in the present embodiment, and it is possible to use another device, provided that it is capable of heating and cooling the air flow. Subsequently, the air flow is supplied from the air outlet 101 by the fan 114, and the air is caused to flow inside the casing 100 of the liquid ejection head and to flow about the periphery of the head main body 104 by the air flow adjusting mechanism 107, thereby preventing evaporation of the solvent from the ink inside the nozzles 105.

In the present embodiment, no mechanism is provided for generating the vapor of the volatile solvent, and therefore, initially, a dummy operation for ejecting ink from the nozzles is carried out, and the air flow is used after the humidity of the air flow has risen. Moreover, in order to increase the humidity in the air flow, droplets of the ink are ejected from the nozzles at a slow speed of approximately 1 m/s so as to suspend the droplets in the air flow, and when the air flow is subsequently recovered through the air inlet 102, the dye or pigment component contained in the ink is trapped by the filter 111, and hence the humidity of the air flow can be raised by extracting the volatile solvent component only. More specifically, the ink ejected from the nozzles 105 includes ink 122 in the form of liquid droplets for carrying out printing onto the recording medium 106, and ink 121 in the form of liquid droplets for supplying the solvent component in order to raise the humidity in the air flow. The ink 121 forming liquid droplets for raising the humidity in the air flow is ejected at a slow speed and is thereby made suspended in the air flow. Consequently, the humidity of the air flow can be controlled by carrying out this process on the basis of the information obtained from the temperature and humidity sensor 112, until the air flow containing the vapor of the volatile solvent has reached the prescribed humidity. Furthermore, the periphery of the air inlet 102 is set to a negative pressure by means of a fan 114 provided inside the air flow circulation mechanism 103, and hence it assumes a pressure that is lower than atmospheric pressure. The arrangement sequence of the filter 111, the temperature and humidity sensor 112, the heat pipe 113, and the fan 114 in FIG. 10 is not limited to the sequence described above, and they may also be arranged, for instance, in the following order in the direction of the air flow: the heat pipe 113, the filter 111, the fan 114, and the temperature and humidity sensor 112.

Here, the ejection speed when ejecting ink droplets for image formation is around 10 m/s in the case of a piezo actuator system, around 15 m/s in the case of a thermal jet system, and around 20 m/s in the case of a continuous system, and although it is governed by the size of the ejection force, generally, the ejection speed is in the range of 7 m/s to 25 m/s. If the ejection speed is slow (within a range where eddies are not produced), then from Stokes' law, the deceleration force caused by the viscous resistance of the air is directly proportional to the radius of the ink droplet. On the other hand, the weight of the ink droplet is directly proportional to the third power of the radius of the ink droplet, and hence the rate of acceleration during deceleration due to viscous resistance is directly proportional to $1/(\text{radius})^2$. Consequently, if the radius of the ink droplet is large, then the time required to decelerate the ink droplet becomes correspondingly longer, and if the radius of the ink droplet is small, then the ink droplet is decelerated rapidly, even if the ejection speed is fast. The functional requirements in the present embodiment are that the ink droplets should be ejected at an ejection speed whereby the ink droplets assume a flight speed of 0 m/s due to air resistance before reaching the recording medium 106, such as paper. The ejection speed that satisfies this requirement varies depending on the size of the ink droplet ejected. In the present embodiment, the image forming apparatus uses a piezo actuator method and therefore the ejected ink volume is 1 pl to 2 pl. Consequently, the speed of the ink droplets required in order to raise the humidity of the air flow as described above is 1 (m/s), which is a slower speed than the ejection speed of the ink droplets when ejecting the ink droplets for image formation. This ejection speed should be a value that allows the flight speed of the ink droplets to become 0 m/s before reaching the recording medium 106, such as paper, and it varies depending on the system used in the image forming apparatus.

Moreover, if printing continues for a long period of time, then there arise nozzles that are not used at all. If nozzles continue in an unused state for a long period of time, then even if the air flow containing the vapor of the volatile solvent is circulated, cases may arise in which it is not possible completely to prevent the evaporation of solvent from the ink in the nozzles which have not been used, and the ink increases in viscosity.

In a case of this kind, the ink is ejected from the nozzles at the lowest possible speed and made suspended in the air flow, and the ink droplets are recovered through the air inlet 102 in such a manner that they do not adhere to the recording medium 106. The components in the recovered ink apart from the volatile solvent are trapped by the filter 111.

The filter 111 becomes soiled due to the components other than the volatile solvent in the ink, and the like, and therefore it is replaced in accordance with the volume of ink droplets recovered. Alternatively, the filter member may be constituted by a continuous band-shaped member, and the filter may be wound up in accordance with the volume of ink droplets recovered, in such a manner that the soiled portion of the filter is replaced with a clean portion.

Moreover, a cleaning mechanism for the filter 111 can be provided, and according to requirements, the soiling due to the ink components other than the volatile solvent, and the like, can be removed from the filter.

The circulation path of the air flow in the liquid ejection head and the constituent members present in the circulation path according to the embodiment of the present invention are described.

A circulation device, such as the fan 114, is required in order to circulate the high-temperature high-humidity air flow according to the embodiment of the present invention. The circulation device is, for example, a drive source such as a fan, blower or pump, and more specific embodiments of same are: a commonly known fan, such as a sirocco fan, a propeller fan, a cross-flow fan, a turbo fan, a two-blade blower, a trochoidal pump, a gear pump, or the like; or a blower or pump having a higher compression ratio. A sirocco fan is particularly desirable due to its high discharge pressure, and a cross-flow fan is particularly desirable since it yields a planar air flow.

As shown in the present embodiment, it is necessary to provide either one of: an intake duct, which guides the air flow from the surface of the liquid ejection head where the nozzles 105 are arranged, formed by the head main body 104 and the casing 100 of the liquid ejection head, to the circulation device, such as the fan 114; or an outflow duct for guiding the air flow from the circulation device, such as the fan 114, to the surface of the liquid ejection head on which the nozzles 105 are arranged. Theoretically, a composition which does not have both the intake duct and the outflow duct described above is possible. In other words, if the circulation device, such as the fan 114, is disposed in a position corresponding to the air inlet of an intake duct, or if it is disposed in a position corresponding to the air outlet of the outflow duct, then both the ducts can be omitted. However, in a composition of this kind, the drive source, such as the fan 114, is positioned more closely to the nozzles 105, and hence there is a greater possibility that the air flow at the surface where the nozzles 105 are arranged is disturbed by vibrations, or the like.

Moreover, if the intake duct and the outflow duct are positioned before and after the circulation device, such as the fan 114, then the intake duct is able to extract the air more efficiently, due to the effects of the inertial force of air flow passing at high speed inside the duct, and the outflow duct is able to stabilize the flow of air and to apply a pressure which causes the air flow to pass into the region between the surface where the nozzles 105 are arranged, and the recording medium 106. Consequently, in practical terms, it is desirable to use both the intake duct and the outflow duct, as in the present embodiment. Furthermore, in the present embodiment, since both the intake duct and the outflow duct are formed by the head main body 104 and the casing 100 of the liquid ejection head, then it is possible to reduce the costs of the liquid ejection head because there is no need to provide special duct members.

The filter 111 is provided because if the air flow in the periphery of the liquid ejection head and the air flow circulation mechanism 103 is not clean, then dirt and the like becomes liable to adhere to the interior of the air flow circulation mechanism 103 and the nozzles 105. If dirt, or the like, adheres to the nozzles 105 in this way, then it gives rise to printing defects, and therefore in an actual composition, the filter 111 is necessary.

A volatile solvent vapor generation device, such as the humidifying atomizer nozzle described below, is not necessary in a composition where the solvent evaporating from the nozzles 105 of the liquid ejection head or the solvent in ink droplets ejected from the nozzles 105 is used as a humidifying source, as in the present embodiment. However, it is desirable to provide a volatile solvent vapor generation device in order to improve control over the humidity conditions yet further. Embodiments of the volatile solvent vapor generation device include: a sprayer which sprays a solvent from very fine nozzles, in the form of a mist, and an ultrasonic humidifier or a heat humidifier.

The air flow temperature adjustment device including the heat pipe 113, controls the temperature and humidity state of the circulated humid air flow. Regardless of whether or not a volatile solvent vapor generation device is present, the relative humidity can be raised by lowering the temperature of the circulated air flow by the air flow temperature adjustment device, so that the evaporation of the solvent from the nozzles 105 can be suppressed. Conversely, by raising the temperature of the circulated air flow by means of the air flow temperature adjustment device, it is possible to lower the relative humidity. By controlling the air flow temperature adjustment device in this way, it is possible to obtain the vapor of the solvent, more reliably, in a composition which uses the solvent evaporating from the nozzles 105 of the liquid ejection head, or the solvent in ink droplets ejected from the nozzles 105, as a humidifying source. Moreover, in a composition which uses a volatile solvent vapor generation device, the operation of raising the absolute humidity of the circulating air flow can be performed easily, since there is a supply of solvent that has evaporated from the volatile solvent vapor generation device. After raising the absolute humidity, it is possible to raise the relative humidity by lowering the temperature of the circulating air flow by means of the air flow temperature adjustment device, and hence the solvent vapor in the air flow can be set to a saturated state within a short period of time. When a solvent vapor in a saturated state flows over the surface on which the nozzles 105 are arranged, evaporation of the solvent from the nozzles 105 is virtually eliminated, and hence this is highly desirable.

In order to achieve the functions described above, a desirable composition is one in which an air flow temperature adjustment device for heating and an air flow temperature adjustment device for cooling are provided independently and respectively as the air flow temperature adjustment devices, the air flow temperature adjustment device for heating being disposed on the upstream side in the air flow circulation mechanism 103, and the air flow temperature adjustment device for cooling being disposed on the downstream side. In a composition comprising a volatile solvent vapor generation device, it is desirable to provide the volatile solvent vapor generation device between the air flow temperature adjustment device for heating and the air flow temperature adjustment device for cooling, in the circulation path of the air flow.

More specific embodiments of the air flow temperature adjustment device include, besides a heat pipe, a Peltier element, an electrical heater, and the like. In particular in the case of a composition that has both the air flow temperature adjustment device for heating and the air flow temperature adjustment device for cooling described above, it is possible to improve energy efficiency and to reduce running costs, by disposing the high temperature side and the low temperature side of a heat exchanger, such as a heat pipe or Peltier element, respectively at the position where the air flow temperature adjustment device for heating is provided and the position where the air flow temperature adjustment device for cooling is provided.

The air flow temperature measurement device and the air flow humidity measurement device, which include the temperature and humidity sensor 112, serve to control the temperature and humidity states of the circulated high-humidity air flow. The vapor density measurement device is required to implement control in order to prevent the occurrence of condensation of the solvent in the air flow, and it is desirable to provide the air flow temperature measurement device in order to adjust the humidity through temperature control by means of the air flow temperature adjustment device.

Furthermore, since the solvent diffusion speed in the ink is affected by the temperature, then the amount of solvent evaporating from the nozzles 105 is also affected by the temperature, and therefore it is desirable to measure the temperature of the air flow by means of the air flow temperature measurement device and to control the humidity and temperature of the circulating air flow accordingly. Specific embodiments of the air flow temperature measurement device include: a thermocouple, a thermistor, a thermometric resistor, and the like, and specific embodiments of the vapor density measurement device include: an electrical capacitance type humidity sensor, a resistance change type humidity sensor, and the like. It is also possible to use a temperature and humidity sensor that forms a unit having the functions of both the air flow temperature measurement device and the vapor density measurement device.

Next, the arrangement sequence of the members forming the constituent elements described above is explained. The intake duct and the outflow duct are formed by the head main body 104 and the casing 100 of the liquid ejection head between them, and therefore the arrangement sequence is described in respect of the circulation device, such as the fan 114, the filter 111, the volatile solvent vapor generation device, the air flow temperature adjustment device, such as the heat pipe 113, and the air flow temperature measurement device and the vapor density measurement device constituted by the temperature and humidity sensor 112, and the like. In this description of the sequence, inside the air flow circulation mechanism 103, the side of the intake duct which takes in the air flow that has flowed between the recording medium and the surface where the nozzles 105 are arranged (the side where the air inlet 102 is provided) is taken to be the upstream side, and the side of the outflow duct (the side where the air outlet 101 is provided) is taken to be the downstream side.

In order to prevent dust from adhering to the constituent members inside the air flow circulation mechanism 103 and to the surface on which the nozzles 10S are formed, if the filter 111 is provided, then it is desirable that the filter 111 should be positioned on the furthest upstream side.

Next, from the control viewpoint, a composition where the air flow temperature adjustment device including the heat pipe 113 is disposed on the upstream side and the air flow temperature measurement device is disposed on the downstream side, and a composition where the volatile solvent vapor generation device is disposed on the upstream side and the air flow humidity measurement device is arranged on the downstream side, are respective compositions that allow the temperature and the humidity to be controlled by a closed loop. If the respective elements are disposed in the reverse sequence, then a composition that controls the temperature and humidity by an open loop is achieved. Which of these control compositions is preferable depends on factors such as the dimensions of the liquid ejection head, the overall structure and composition of the apparatus, and the installation environment. In the present embodiment, the composition that implements control by the closed loop is thought to have higher response and therefore this composition is adopted.

Next, from the viewpoint of efficiency, it is desirable that the circulation device, such as the fan 114, should be disposed on the upstream side of the volatile solvent vapor generation device and the air flow temperature adjustment device including the heat pipe 113. This is because it is considered that the volatile solvent vapor generation device and the air flow temperature adjustment device including the heat pipe 113 have higher efficiency, the faster the speed of the air flow when it comes into contact with these devices. If this sequence is reversed, then although the efficiency is slightly reduced, the air flow is taken into the circulation device, such as the fan 114, after having passed the volatile solvent vapor generation device and the air flow temperature adjustment device including the heat pipe 113, and therefore, the air flow is churned and a uniform temperature and humidity state can be expected in the air flow. Consequently, if the uniformity of the temperature and humidity characteristics is considered a priority, then it is desirable to arrange the circulation device, such as the fan 114, on the downstream side.

From the viewpoint of achieving the uniform temperature and humidity characteristics, a beneficial effect is obtained in generating turbulence in the flow of air and causing the air flow to be mixed, by forming the duct shapes in the portion above the air inlet 102 and the portion above the air outlet 101 to have square corner shapes as shown in FIG. 10, rather than a shape that follows the line of the air flow.

Furthermore, with respect to the method of selecting humidity adjustment, if the air flow temperature adjustment device, such as the heat pipe 113, is disposed on the upstream side and the volatile solvent vapor generation device is disposed on the downstream side, then humidification can be carried out after setting the temperature of the air flow, in other words, the saturation vapor pressure in the air flow. Therefore, this arrangement is suitable for preventing condensation. If a reverse arrangement is adopted, then even if the saturated state of the volatile solvent vapor cannot be achieved by means the volatile solvent vapor generation device, it is still possible to obtain the saturated state by lowering the temperature after humidification. Therefore, this arrangement is suitable for obtaining a higher relative humidity.

The most desirable composition is one in which the air flow temperature adjustment device for heating, the volatile solvent vapor generation device, and the air flow temperature adjustment device for cooling are arranged in this order, from the upstream side. This composition is desirable since it enables the temperature of the air flow to be set to a uniform temperature, once the vapor pressure of the volatile solvent has reached the saturated state.

As described above, a desirable composition is one in which the filter 111, the circulation device, such as the fan 114, the volatile solvent vapor generation device, the air flow temperature adjustment device including the heat pipe 113, the air flow temperature measurement device, and the vapor density measurement device, are arranged in this order from the upstream side, in the air flow circulation mechanism 103 according to the present embodiment.

Moreover, a more desirable composition is one in which the filter 111, the circulation device such as the fan 114, the air flow temperature measurement device for heating, the volatile solvent vapor generation device, the air flow temperature measurement device for cooling, the air flow temperature adjustment device including the heat pipe 113, the air flow temperature measurement device, and the vapor density measurement device, are arranged in this order from the upstream side.

As a further method for recovering ink droplets that have been ejected from the nozzles at the slowest possible speed and made suspended in the air flow, in such a manner that this ink does not adhere to the recording medium 106, there is also a method in which the ink is electrically charged and then recovered.

Figure 8:
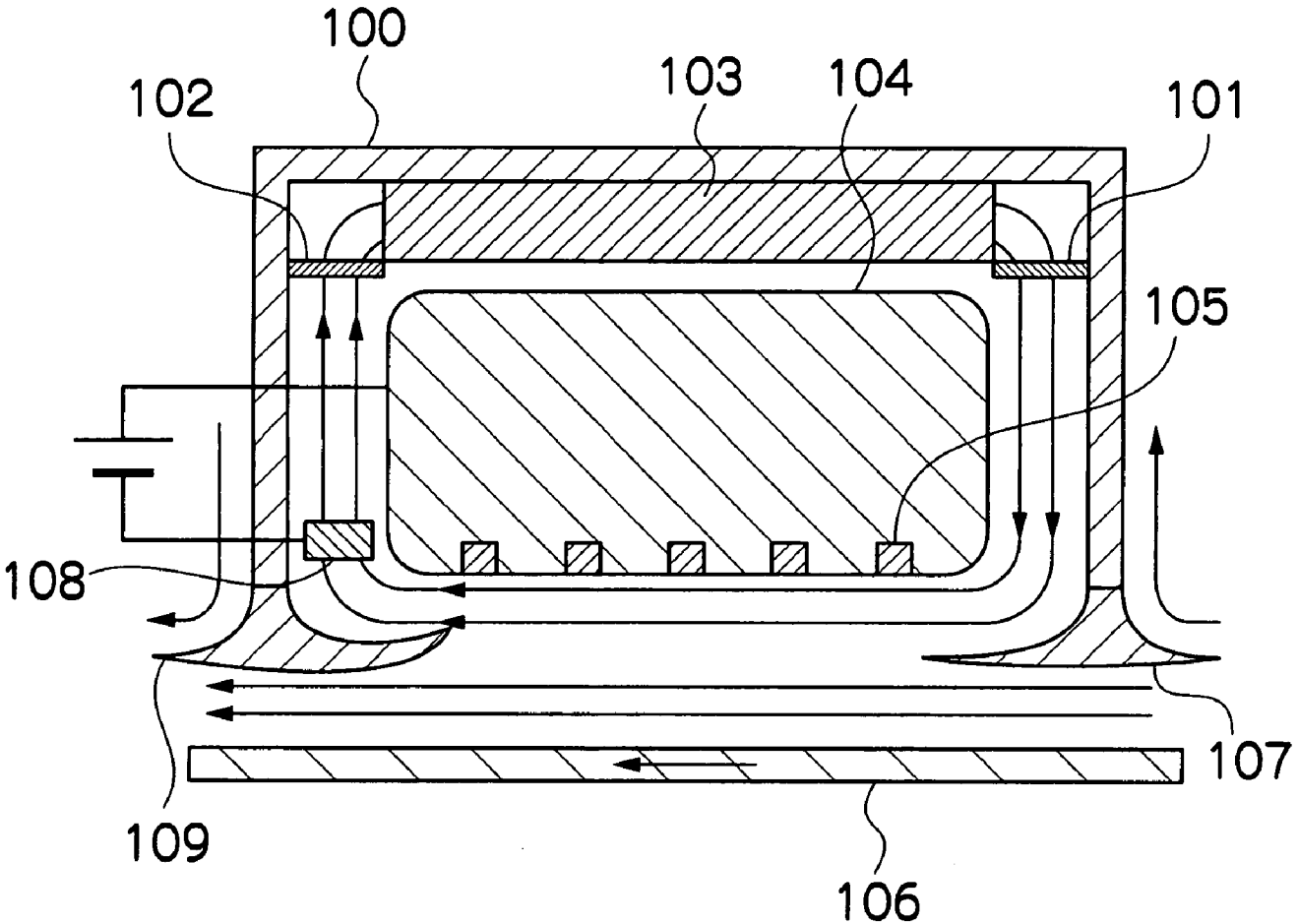
FIG. 8 is a cross-sectional diagram of a modification of the liquid ejection head according to the first embodiment of the present invention.

This is described now with reference to FIG. 8.

The air flow circulated inside the casing 100 of the liquid ejection head is supplied from the air outlet 101 and is changed in direction to flow along the front surface of the liquid ejection head 104 where the nozzles 105 are provided, by means of the air flow adjusting mechanism 107. If the ink in the nozzles 105 has become highly viscous, then the ink ejected from the nozzles 105 can be charged by setting the whole of the head main body 104 to a prescribed electrical potential. Furthermore, besides this, it is also possible to charge a desired portion of the ink only, by providing electrodes for charging the ink in the vicinity of the respective nozzles 105. Ink is ejected from the head 105 at the slowest possible speed in such a manner that it is carried by the air flow and recovered, rather than being deposited onto the recording medium 106.

The air flow is subsequently recovered through the air inlet 102, and a mesh 108, which is a liquid droplet attracting device for attracting the charged ink, is provided before the air inlet 102. By applying a prescribed electric field between the head main body 104 and the mesh 108, the charged ink is electrostatically attracted to the mesh 108. Furthermore, in order to prevent dripping of the ink adhering to the mesh 108, the end of the air flow adjusting mechanism 109 on the side close to the nozzles 105 is bent upwards. Any ink that has accidentally passed through the mesh 108 is recovered through the air inlet 102 and then trapped by the filter provided in the air flow circulation mechanism 103.

By carrying out the task of recovering the ink of increased viscosity during the time period between the end of printing and the start of the next printing operation which occurs between respective print sheets, it is possible to recover the ink without creating a time loss. Therefore, it is possible to reduce the frequency of carrying out preliminary ejection, which is a time consuming operation.

Figure 9:
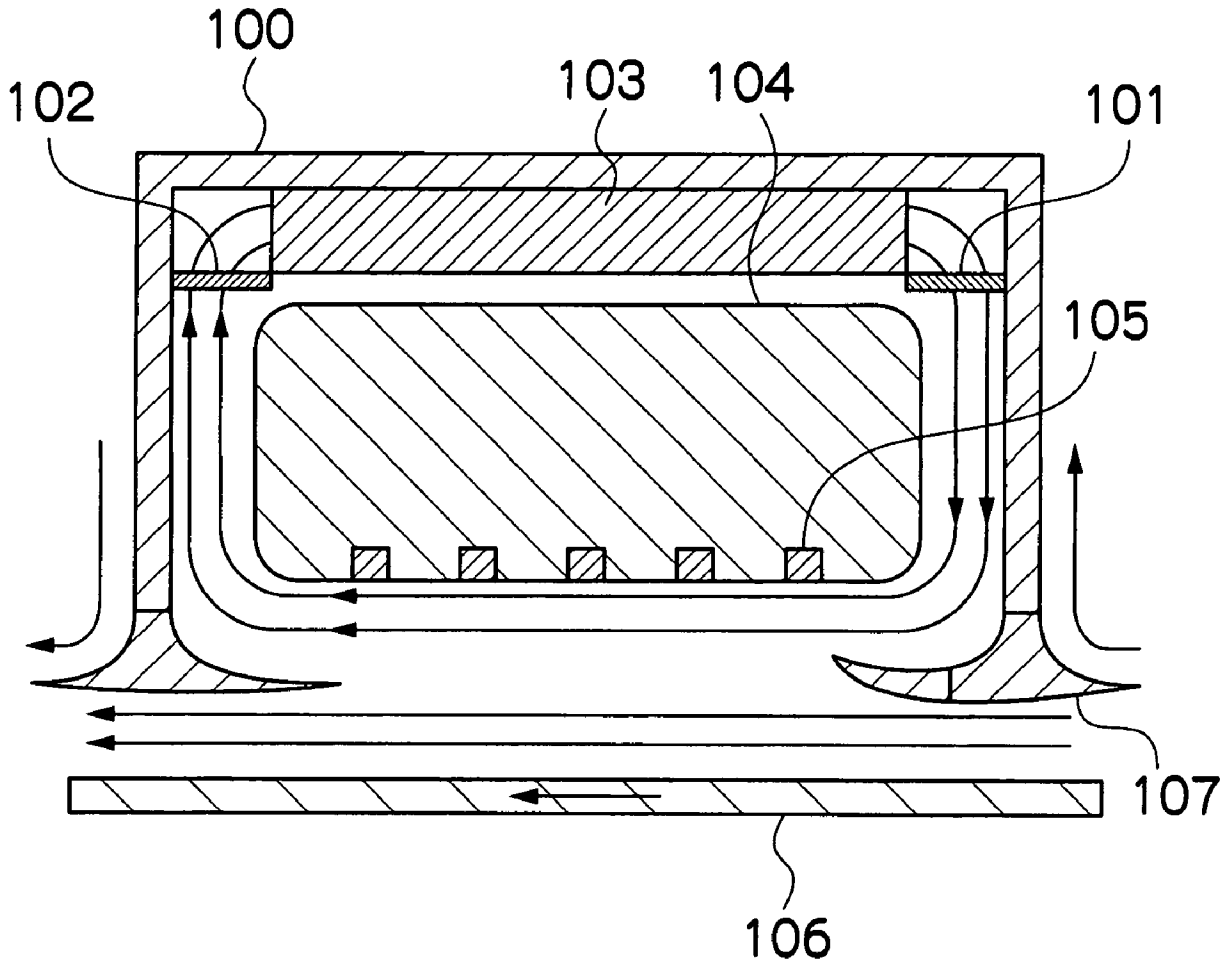
FIG. 9 is a cross-sectional diagram of a liquid ejection head according to a second embodiment of the present invention.

A second embodiment of the present invention is now described with reference to FIG. 9.

In the second embodiment, the speed of the air flow containing the vapor of the volatile solvent is accelerated.

More specifically, the end of the air flow adjusting mechanism 107 on the head main body 104 side is alterable in such a manner that it can be moved closer to the head main body 104, thus yielding a structure in which the gap at this portion is narrower than the gap formed between the rest of the casing 100 and the head main body 104. Therefore, the air flow containing the vapor of the volatile solvent that flows between the recording medium 106 and the head main body 104 is caused to have a high speed in the vicinity of the nozzles 105.

The air flow containing the vapor of the volatile solvent is subsequently recovered through the air inlet 102, passed through the air flow circulation mechanism 103 and then supplied again from the air outlet 101.

Moreover, even in the case of the composition shown in FIG. 7, although not shown in the drawings, it is also possible to achieve a high speed air flow by using a high-output device for the fan provided in the air flow circulation mechanism 103.

In this way, in the second embodiment, by accelerating the air flow containing the vapor of the volatile solvent that passes the ends of the nozzles 105 and thus exposing the ends of the nozzles 105 to the high-speed air flow containing the vapor of the volatile solvent, evaporation of the volatile solvent in the ink is prevented effectively, and furthermore, dust, ink mist, or the like, adhering to the vicinity of the nozzles 105 can also be blown away.

Figure 11:
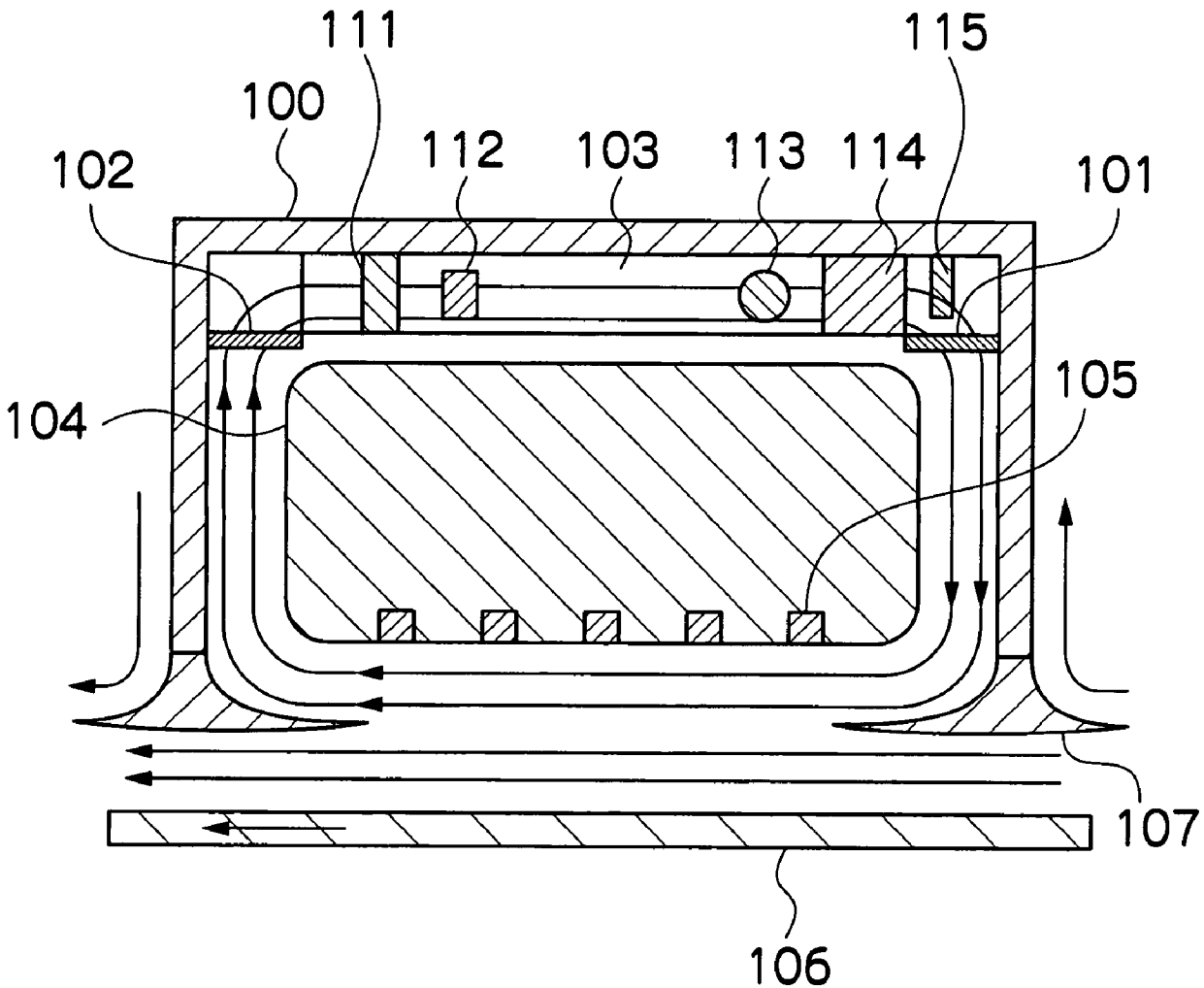
FIG. 11 is a partially transparent cross-sectional diagram of the liquid ejection head according to a third embodiment of the present invention.

A third embodiment of the present invention is described with reference to FIG. 11.

The third embodiment has a composition in which a humidifying atomizer nozzle is provided as the volatile solvent vapor generation device.

The whole of the liquid ejection head apart from the surface opposing the recording medium 106, such as paper, is covered with the casing 100, and the air flow containing the vapor of the volatile solvent, namely, the air flow containing water vapor, is circulated through the periphery of the head main body 104 inside the casing 100.

In the present embodiment, the ink contains the dye or pigment, other additives, and the solvent composed of glycerin and water in the ratio 4:6. At room temperature, this ink has the virtually saturated state at 86% RH, and therefore the humidity of the air flow containing water vapor, which is the air flow containing the vapor of the volatile solvent, desirably has as high humidity as possible provided that condensation does not occur. Preferably, the humidity is 80% through 100%, and more preferably 80% through 90%.

The air flow containing the vapor of the volatile solvent is supplied from the air flow supply port 101, and the direction of flow is changed from the side face to the front surface of the head main body 104 by means of the air flow adjusting mechanism 107 provided in the casing 100. The nozzles 105 are provided on the front surface of the head main body 104, and the air flow containing the vapor of the volatile solvent flows over the front surface of the head main body 104 in such a manner that the volatile solvent component in the ink in the nozzles 105 does not evaporate. The air flow containing the vapor of the volatile solvent that flows over the front surface of the head main body 104 is subsequently changed to flow along the side face of the head main body 104 and is recovered through the air inlet 102. The air flow containing the vapor of the volatile solvent recovered through the air inlet 102 is supplied again from the air outlet 101, by means of the air flow circulation mechanism 103.

The air flow containing the vapor of the volatile solvent recovered through the air inlet 102 is passed through the filter 111 provided inside the air flow circulation mechanism 103, thereby removing dust or dirt contained in the air flow. After passing through the filter 111, the air flow is passed in the vicinity of the humidity and temperature sensor 112, which constitutes the air flow temperature measurement device and the vapor density measurement device, and the temperature and the humidity of the air flow are duly measured. The information obtained by the temperature and humidity sensor 112 is sent to the system controller 72 and the print controller 80 shown in FIG. 6, and the measured values are compared with prescribed temperature and humidity values.

If the temperature of the air flow is lower or higher than the prescribed temperature, then the air flow containing the vapor of the volatile solvent is heated or cooled so as to assume the prescribed temperature, by means of the heat pipe 113, which is the air flow temperature adjustment device, provided on the downstream side of the sensor 112. The heat pipe 113 is described as an example of the air flow heating and cooling device in the present embodiment, and it is possible to use another device, provided that it is capable of heating and cooling the air flow. Subsequently, the air flow containing the vapor of the volatile solvent has been accelerated by the fan 114, and if the humidity measured by the temperature and humidity sensor 112 is lower than the prescribed humidity, then the vapor of the volatile solvent is added to the air flow by the humidifying atomizer nozzle 115, which is the volatile solvent vapor generation device, in such a manner that the air flow assumes the prescribed humidity. Thereupon, the air flow is supplied again from the air outlet 101.

The solvent vapor is gradually lost by partial dispersion and therefore, provided that the air flow temperature is maintained at a prescribed temperature, the humidity never becomes higher than the prescribed humidity. Although the elements are arranged in FIG. 11 in the following order: the filter 111, the temperature and humidity sensor 112, the heat pipe 113, and the fan 114, the arrangement sequence is not limited to this sequence.

Figure 12:
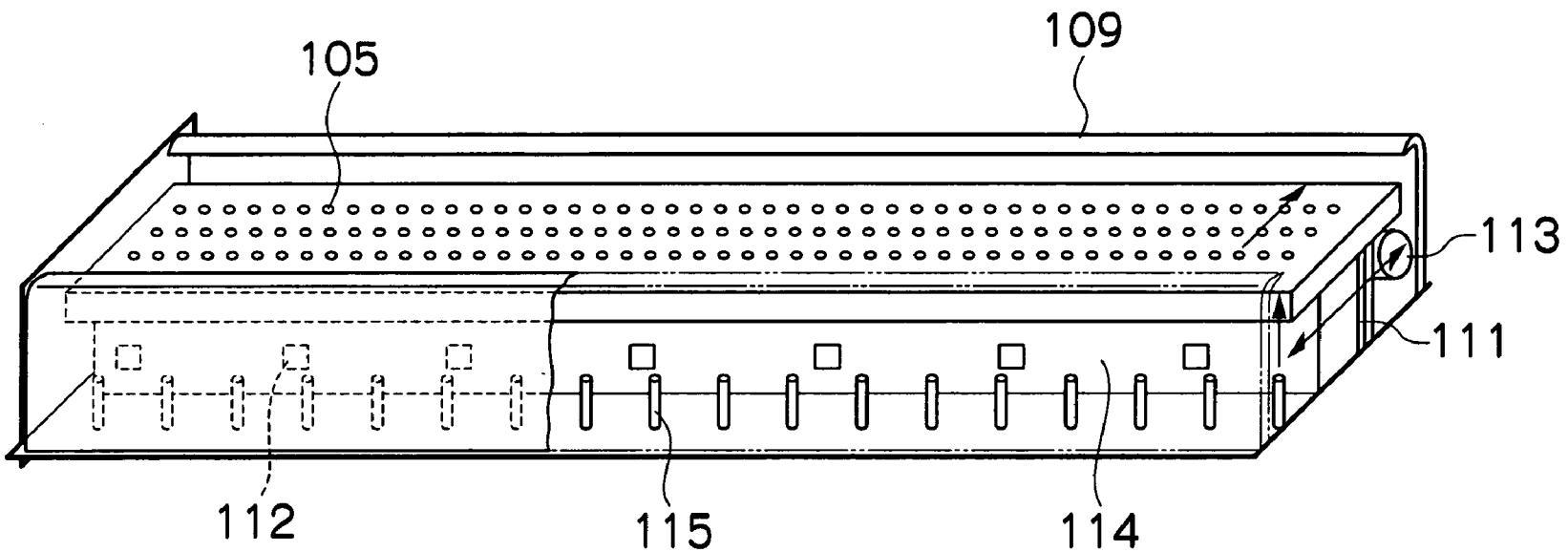
FIG. 12 is a perspective diagram of the liquid ejection head according to the third embodiment of the present invention.

More specifically, as shown in FIG. 12, it is possible to arrange the heat pipe 113, the filter 111, the fan 114, and the temperature and humidity sensor 112, in this order, following the flow direction of the air flow, and it is also possible to adopt a composition in which the vapor of the volatile solvent is added to the air flow by the humidifying atomizer nozzles 115, as and when necessary, and the air flow is then caused to flow again over the surface where the nozzles 105 are arranged.

The liquid ejection head described in the first to third embodiments further incorporates a function for recovering the ink mist generated when ink is ejected, and also a function for removing foreign material, such as a fibrous material of the recording medium, like paper fibers, or dust, or the like, which is floating in the vicinity of the nozzles. Thus, it is possible to prevent the recording medium from becoming stained with the ink mist, and also to prevent ejection failures in the head by preventing the foreign material from adhering to the nozzles.

Moreover, the air flow adjusting mechanisms 107 and 109 have the beneficial effect of protecting the nozzles 105 of the liquid ejection head from abnormalities such as paper jams, when the recording medium 106 is conveyed. The invention is not limited in particular to the composition where the air flow circulation mechanism 103 is disposed above the head main body 104, as shown in the first to third embodiments, and it is also possible to adopt a composition in which the air flow circulation mechanism 103 is disposed in a position that is distant from the head main body 104, the air flow is guided from the air inlet 102 to the air flow circulation mechanism 103 through a pipe, or the like, and the air flow circulation mechanism 103 is connected to the air outlet 101 through a pipe, or the like. Furthermore, in this case, after sending the air flow from respective air inlets 102 provided in the liquid ejection heads of the respective colors, to a common air flow circulation mechanism 103, and then supplying the air flow again from the air outlets 101 provided in the liquid ejection heads, it is possible to use the single air flow circulation mechanism 103 and hence the overall image forming apparatus can be made compact in size.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a casing;

nozzles which eject droplets of liquid containing a volatile solvent and are arranged on a nozzle face in the casing;

an air outlet which supplies an air flow containing a vapor of the volatile solvent and is arranged on an upstream side in the air flow with respect to the nozzle face;

an air inlet which recovers the air flow containing the vapor of the volatile solvent supplied from the air outlet and is arranged on the downstream side in the air flow with respect to the nozzle face; and an air flow circulation mechanism including a circulation device which resupplies, from the air outlet, the air flow containing the vapor of the volatile solvent recovered through the air inlet, wherein the air flow containing the vapor of the volatile solvent is circulated inside the casing.

2. A liquid ejection head, comprising:

nozzles which eject droplets of liquid containing a volatile solvent and are arranged on a nozzle face;

an air outlet which supplies an air flow containing a vapor of the volatile solvent and is arranged on an upstream side in the air flow with respect to the nozzle face;

an air inlet which recovers the air flow containing the vapor of the volatile solvent supplied from the air outlet and is arranged on the downstream side in the air flow with respect to the nozzle face; and an air flow circulation mechanism including a circulation device which resupplies, from the air outlet, the air flow containing the vapor of the volatile solvent recovered through the air inlet, wherein:

a direction of the air flow containing the vapor of the volatile solvent with respect to the nozzle face is same with a direction in which a recording medium which receives recording by the liquid ejection head moves with respect to the liquid ejection head; and a relative speed of the air flow containing the vapor of the volatile solvent with respect to the liquid ejection head, at an interface between the air flow containing the vapor of the volatile solvent and an air flow generated by a relative movement of the recording medium with respect to the liquid ejection head, is within 50% through 120% of a relative speed of the recording medium with respect to the liquid ejection head.

3. The liquid ejection head as defined in claim 1, wherein, before performing image formation with the liquid ejection head, droplets of the liquid are ejected from the nozzles at a slower speed than an ejection speed of droplets of the liquid necessary for the image formation, and the droplets of the liquid are recovered through the air inlet, by means of the air flow supplied from the air outlet.

4. The liquid ejection head as defined in claim 1, further comprising:

a vapor density measurement device which measures a density of the vapor of the volatile solvent in the air flow containing the vapor of the volatile solvent, in a circulation path of the air flow containing the vapor of the volatile solvent inside the air flow circulation mechanism; and a volatile solvent vapor generation device which generates the vapor of the volatile solvent and is arranged in the air flow circulation mechanism, wherein the density of the vapor of the volatile solvent in the air flow containing the vapor of the volatile solvent is maintained at a prescribed value by generating the vapor of the volatile solvent by means of the volatile solvent vapor generation device, in accordance with measurement results obtained from the vapor density measurement device.

5. The liquid ejection head as defined in claim 1, further comprising:

an air flow temperature measurement device which measures a temperature of the air flow containing the vapor of the volatile solvent, in a circulation path of the air flow containing the vapor of the volatile solvent inside the air flow circulation mechanism; and an air flow temperature adjustment device which adjusts the temperature of the air flow containing the vapor of the volatile solvent and is arranged in the air flow circulation mechanism, wherein the temperature of the air flow containing the vapor of the volatile solvent is maintained at a prescribed value by means of the air flow temperature adjustment device, in accordance with measurement results obtained from the air flow temperature measurement device.

6. The liquid ejection head as defined in claim 1, further comprising:

a volatile solvent vapor generation device which generates the vapor of the volatile solvent and is arranged in the air flow circulation mechanism;

an air flow temperature measurement device which measures a temperature of the air flow containing the vapor of the volatile solvent, in a circulation path of the air flow containing the vapor of the volatile solvent inside the air flow circulation mechanism; and an air flow temperature adjustment device which adjusts the temperature of the air flow containing the vapor of the volatile solvent and is arranged in the air flow circulation mechanism, wherein:

the temperature of the air flow containing the vapor of the volatile solvent is maintained at a prescribed value by means of the air flow temperature adjustment device, in accordance with measurement results obtained from the air flow temperature measurement device; and the circulation device, the volatile solvent vapor generation device, the air flow temperature adjustment device and the air flow temperature measurement device are arranged in this order in a direction from the air inlet toward the air outlet inside the air flow circulation mechanism.

7. The liquid ejection head as defined in claim 1, further comprising:

a vapor density measurement device which measures a density of the vapor of the volatile solvent in the air flow containing the vapor of the volatile solvent, in a circulation path of the air flow containing the vapor of the volatile solvent inside the air flow circulation mechanism;

a volatile solvent vapor generation device which generates the vapor of the volatile solvent and is arranged in the air flow circulation mechanism; and an air flow temperature adjustment device which adjusts the temperature of the air flow containing the vapor of the volatile solvent and is arranged in the air flow circulation mechanism, wherein:

the density of the vapor of the volatile solvent in the air flow containing the vapor of the volatile solvent is maintained at a prescribed value by generating the vapor of the volatile solvent by means of the volatile solvent vapor generation device, in accordance with measurement results obtained from the vapor density measurement device; and the circulation device, the volatile solvent vapor generation device, the air flow temperature adjustment device and the vapor density measurement device are arranged in this order in a direction from the air inlet toward the air outlet inside the air flow circulation mechanism.

8. The liquid ejection head as defined in claim 1, further comprising:

a volatile solvent vapor generation device which generates the vapor of the volatile solvent and is arranged in the air flow circulation mechanism;

an air flow temperature measurement device which measures a temperature of the air flow containing the vapor of the volatile solvent, in a circulation path of the air flow containing the vapor of the volatile solvent inside the air flow circulation mechanism; and an air flow temperature adjustment device which adjusts the temperature of the air flow containing the vapor of the volatile solvent and is arranged in the air flow circulation mechanism, the air flow temperature adjustment device including a heating device and a cooling device which heat and cool the air flow containing the vapor of the volatile solvent, wherein:

the temperature of the air flow containing the vapor of the volatile solvent is maintained at a prescribed value by means of the air flow temperature adjustment device, in accordance with measurement results obtained from the air flow temperature measurement device; and the circulation device, the heating device of the air flow temperature adjustment device, the volatile solvent vapor generation device, the cooling device of the air flow temperature adjustment device and the air flow temperature measurement device are arranged in this order in a direction from the air inlet toward the air outlet inside the air flow circulation mechanism.

9. The liquid ejection head as defined in claim 1, further comprising:

a vapor density measurement device which measures a density of the vapor of the volatile solvent in the air flow containing the vapor of the volatile solvent, in a circulation path of the air flow containing the vapor of the volatile solvent inside the air flow circulation mechanism;

a volatile solvent vapor generation device which generates the vapor of the volatile solvent and is arranged in the air flow circulation mechanism; and an air flow temperature adjustment device which adjusts the temperature of the air flow containing the vapor of the volatile solvent and is arranged in the air flow circulation mechanism, the air flow temperature adjustment device including a heating device and a cooling device which heat and cool the air flow containing the vapor of the volatile solvent, wherein:

the density of the vapor of the volatile solvent in the air flow containing the vapor of the volatile solvent is maintained at a prescribed value by generating the vapor of the volatile solvent by means of the volatile solvent vapor generation device, in accordance with measurement results obtained from the vapor density measurement device; and the circulation device, the heating device of the air flow temperature adjustment device, the volatile solvent vapor generation device, the cooling device of the air flow temperature adjustment device and the vapor density measurement device are arranged in this order in a direction from the air inlet toward the air outlet inside the air flow circulation mechanism.

10. The liquid ejection head as defined in claim 1, wherein a partial pressure of the volatile solvent in the air flow containing the vapor of the volatile solvent is within 80% through 100% of a saturation vapor pressure of the volatile solvent in the air flow containing the vapor of the volatile solvent around the nozzles.

11. The liquid ejection head as defined in claim 1, further comprising an air flow adjusting mechanism including a component member through which a plane passes, the plane being obtained by extending an interface between the air flow containing the vapor of the volatile solvent and an air flow generated by a relative movement of a recording medium with respect to the liquid ejection head, the recording medium receiving recording by the liquid ejection head, the component member having a face parallel with the plane, wherein the air flow adjusting mechanism has an end on a side close to the nozzles and an end on a side distant from the nozzles, the end on the side close to the nozzles having a shape acuter than the end on the side distant from the nozzles.

12. The liquid ejection head as defined in claim 1, wherein a pressure at the air inlet is lower than atmospheric pressure.

13. The liquid ejection head as defined in claim 1, wherein, after performing image formation with the liquid ejection head for prescribed duration, droplets of the liquid are ejected from the nozzles at a slower speed than an ejection speed of droplets of the liquid necessary for the image formation, and the droplets of the liquid are recovered through the air inlet, by means of the air flow supplied from the air outlet.

14. The liquid ejection head as defined in claim 1, wherein, from at least one of the nozzles that ejects droplets of the liquid not more than prescribed volume per prescribed duration, droplets of the liquid are ejected at a slower speed than an ejection speed of droplets of the liquid necessary for performing image formation with the liquid ejection head, and the droplets of the liquid are recovered through the air inlet, by means of the air flow supplied from the air outlet.

15. The liquid ejection head as defined in claim 1, further comprising:

a liquid droplet charging device which applies electric charges to the droplets of the liquid; and a liquid droplet attraction device which is arranged around the air inlet, wherein the charged droplets of the liquid are attracted by applying an electric field to the liquid droplet attraction device.

16. The liquid ejection head as defined in claim 1, further comprising a liquid droplet attraction device which is arranged around the air inlet, wherein an electric potential difference is applied between the nozzles and the liquid droplet attraction device.

17. An image forming apparatus comprising the liquid ejection head as defined in claim 1.

* * * * *